US010573132B2

(12) United States Patent
Oyama et al.

(10) Patent No.: US 10,573,132 B2
(45) Date of Patent: Feb. 25, 2020

(54) INFORMATION PROCESSOR, NON-TRANSITORY COMPUTER-READABLE MEDIUM, AND GAME CONTROL METHOD

(71) Applicant: Universal Entertainment Corporation, Koto-Ku Tokyo (JP)

(72) Inventors: Masaki Oyama, Tokyo (JP); Atsushi Kumita, Tokyo (JP); Toshikazu Jinnouchi, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 0 days.

(21) Appl. No.: 16/127,944

(22) Filed: Sep. 11, 2018

(65) Prior Publication Data

US 2019/0096194 A1 Mar. 28, 2019

(30) Foreign Application Priority Data

Sep. 28, 2017 (JP) ..... 2017-187774

(51) Int. Cl.

| | |
|---|---|
| ***G07F 17/00*** | (2006.01) |
| ***G07F 19/00*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/326* (2013.01); *G07F 17/3213* (2013.01)

(58) Field of Classification Search

CPC ..... G07F 17/3213; G07F 17/326; G07F 17/3262; G07F 17/34

See application file for complete search history.

(56) References Cited

U.S. PATENT DOCUMENTS

| | | | | |
|---|---|---|---|---|
| 7,744,458 | B2 * | 6/2010 | Marks | G07F 17/34 463/16 |
| 2003/0186737 | A1 * | 10/2003 | Bennett | G07F 17/3244 463/20 |
| 2006/0160605 | A1 * | 7/2006 | Hornik | G07F 17/32 463/20 |
| 2011/0266745 | A1 * | 11/2011 | Gruber | G07F 17/34 273/143 R |

FOREIGN PATENT DOCUMENTS

WO 2016136749 A1 9/2016

* cited by examiner

*Primary Examiner* — Milap Shah

(74) *Attorney, Agent, or Firm* — Potomac Law Group, PLLC; Kenneth Fagin

(57) ABSTRACT

The present invention provides an information processor, a game program, and a game control method capable of performing various presentations for the result display of the rearrangement of the symbols. The information processor 1 displays the symbol display area 21 having the scroll areas 211 to 216 in which the win determination line 400 is set on the slot game screen 20. In the winning determination, the information processor 1 determines whether to employ either the winning determination based on the "LEFT TO RIGHT" or the winning determination based on the "RIGHT TO LEFT" for the symbols 500 to be rearranged in the winning determination line 400 according to the type of the symbols 500 to be rearranged.

6 Claims, 12 Drawing Sheets

FIG.8

FIRST SYMBOL COMBINATION TABLE

| SYMBOL | 1 | 2 | 3 | 4 | 5 | FIRST WINNING DETERMINATION | SECOND WINNING DETERMINATION | SCATTER |
|---|---|---|---|---|---|---|---|---|
| WILD | 0 | 0 | 0 | 0 | 0 | TRUE | TRUE | FALSE |
| BONUS | 0 | 0 | 50 | 50 | 50 | FALSE | FALSE | TRUE |
| WHITE NIGHT | 0 | 0 | 35 | 200 | 800 | TRUE | FALSE | FALSE |
| BRACK NIGHT | 0 | 0 | 30 | 100 | 500 | FALSE | TRUE | FALSE |
| WHITE HORSE | 0 | 0 | 20 | 50 | 400 | TRUE | FALSE | FALSE |
| BLACK HORSE | 0 | 0 | 15 | 35 | 300 | FALSE | TRUE | FALSE |
| ACE | 0 | 0 | 10 | 30 | 200 | TRUE | TRUE | FALSE |
| KING | 0 | 0 | 10 | 20 | 200 | TRUE | TRUE | FALSE |
| QUEEN | 0 | 0 | 10 | 15 | 100 | TRUE | TRUE | FALSE |
| JACK | 0 | 0 | 10 | 15 | 100 | TRUE | TRUE | FALSE |
| TEN | 0 | 0 | 5 | 15 | 100 | TRUE | TRUE | FALSE |
| NINE | 0 | 0 | 5 | 10 | 100 | TRUE | TRUE | FALSE |

FIG.9

SECOND SYMBOL COMBINATION TABLE

| SYMBOL | 1 | 2 | 3 | 4 | 5 | FIRST WINNING DETERMINATION | SECOND WINNING DETERMINATION | SCATTER |
|---|---|---|---|---|---|---|---|---|
| WILD | 0 | 0 | 0 | 0 | 0 | TRUE | TRUE | FALSE |
| BONUS | 0 | 0 | 50 | 50 | 50 | FALSE | FALSE | TRUE |
| WHITE NIGHT | 0 | 0 | 30 | 100 | 500 | TRUE | FALSE | FALSE |
| BRACK NIGHT | 0 | 0 | 35 | 200 | 800 | FALSE | TRUE | FALSE |
| WHITE HORSE | 0 | 0 | 15 | 35 | 300 | TRUE | FALSE | FALSE |
| BLACK HORSE | 0 | 0 | 20 | 50 | 40 | FALSE | TRUE | FALSE |
| ACE | 0 | 0 | 10 | 30 | 200 | TRUE | TRUE | FALSE |
| KING | 0 | 0 | 10 | 20 | 200 | TRUE | TRUE | FALSE |
| QUEEN | 0 | 0 | 10 | 15 | 100 | TRUE | TRUE | FALSE |
| JACK | 0 | 0 | 10 | 15 | 100 | TRUE | TRUE | FALSE |
| TEN | 0 | 0 | 5 | 15 | 100 | TRUE | TRUE | FALSE |
| NINE | 0 | 0 | 5 | 10 | 100 | TRUE | TRUE | FALSE |

FIG.10

SYMBOL ARRAY OF THE VIDEO REEL

| | REEL 1 | REEL 2 | REEL 3 | REEL 4 | REEL 5 | REEL 6 |
|---|---|---|---|---|---|---|
| 0 | WHITE NIGHT | NINE | BLACK HORSE | BLACK HORSE | NINE | KING |
| 1 | BLACK HORSE | JACK | KING | KING | JACK | ACE |
| 2 | WHITE NIGHT | WHITE NIGHT | NINE | NINE | WILD | BRACK NIGHT |
| 3 | JACK | BONUS | ACE | ACE | NINE | KING |
| 4 | KING | TEN | BRACK NIGHT | BRACK NIGHT | JACK | WHITE HORSE |
| 5 | WHITE HORSE | NINE | TEN | TEN | WHITE NIGHT | BLACK HORSE |
| 6 | WHITE HORSE | ACE | WHITE HORSE | BRACK NIGHT | KING | QUEEN |
| 7 | WHITE HORSE | WHITE NIGHT | TEN | TEN | JACK | BRACK NIGHT |
| 8 | JACK | JACK | WHITE HORSE | WHITE HORSE | TEN | JACK |
| 9 | NINE | WHITE HORSE | TEN | TEN | BRACK NIGHT | NINE |
| 10 | ACE | NINE | WHITE HORSE | WHITE HORSE | TEN | BLACK HORSE |
| 11 | JACK | WHITE HORSE | JACK | JACK | ACE | TEN |
| 12 | ACE | ACE | KING | KING | ACE | BONUS |
| 13 | WHITE HORSE | QUEEN | WHITE NIGHT | WHITE NIGHT | NINE | ACE |
| 14 | KING | NINE | BONUS | BONUS | QUEEN | JACK |
| 15 | QUEEN | KING | TEN | TEN | BONUS | NINE |
| 16 | BRACK NIGHT | WILD | WHITE NIGHT | WHITE NIGHT | BLACK HORSE | KING |
| 17 | JACK | ACE | QUEEN | QUEEN | BLACK HORSE | JACK |
| 18 | TEN | QUEEN | TEN | TEN | ACE | ACE |
| 19 | NINE | WHITE HORSE | WILD | WILD | KING | BRACK NIGHT |
| 20 | NINE | TEN | QUEEN | QUEEN | WHITE HORSE | QUEEN |
| 21 | BRACK NIGHT | NINE | TEN | TEN | TEN | ACE |
| 22 | JACK | QUEEN | BLACK HORSE | BLACK HORSE | BRACK NIGHT | NINE |
| 23 | TEN | BLACK HORSE | ACE | ACE | NINE | BLACK HORSE |
| 24 | WHITE HORSE | ACE | QUEEN | QUEEN | TEN | TEN |
| 25 | JACK | NINE | QUEEN | QUEEN | BLACK HORSE | ACE |
| 26 | | BONUS | WHITE NIGHT | WHITE NIGHT | KING | BLACK HORSE |
| 27 | | TEN | NINE | NINE | BRACK NIGHT | QUEEN |
| 28 | | BRACK NIGHT | | | BLACK HORSE | ACE |
| 29 | | WHITE NIGHT | | | | WHITE NIGHT |
| 30 | | WHITE HORSE | | | | TEN |
| 31 | | | | | | BRACK NIGHT |
| 32 | | | | | | ACE |
| 33 | | | | | | KING |

INFORMATION PROCESSOR, NON-TRANSITORY COMPUTER-READABLE MEDIUM, AND GAME CONTROL METHOD

CROSS-REFERENCE TO RELATED APPLICATION

This application claims the benefit of Japanese Pat. App. No. 2017-187774, filed on Sep. 28, 2017, which application is incorporated herein by reference in its entirety.

BACKGROUND OF THE INVENTION

1. Field of Invention

The present invention relates to an information processor, a non-transitory computer-readable medium, and a game control method.

2. Description of Related Art

In the related art, there are various types of games to be performed by a home type game console device, a game device installed in a facility, or an information processor such as a smart phone. For example, there is a slot game in which a slot game is played by betting various gaming mediums (currency in a game or the like) and a slot game in which a benefit (payout) is given based on a the gaming mediums and a combination of symbols (game result) displayed on a screen. In such a game, it is based on enjoying by repeating a cycle game (unit game) from the start of the game until obtaining the game result (see International Publication No. WO2016/136749A1).

Wherein, in a slot game, it is common that a winning determination method called "LEFT TO RIGHT" is adopted. The "LEFT TO RIGHT" is a determination method by which it is determined to win when a predetermined number or more of the same symbols stop continuously from the leftmost on a payline set on a plurality of variation reels. In the slot game, it is common that the variation stops from the leftmost reel in order, so the user can understand that there is no winning before the variation display of all the reels stops, and thus the subsequent time to the stop display becomes a stress to the user, and it is a challenge to have diversity to reduce the stress for the result display of the rearrangement of symbols.

BRIEF SUMMARY OF THE INVENTION

Therefore, an object of the present invention is to provide an information processor, a non-transitory computer-readable medium, and a game control method capable of performing various presentations for the result display of the rearrangement of the symbols.

The information processor of the present invention comprises:

a display for displaying a screen; and a controller, the controller being programmed to execute:

a process of setting a winning determination line composed of a first to a Nth cells each of which is one cell selected from each of a first to a Nth scroll areas provided in a symbol display frame which is displayed in the screen, and each scroll area is composed of a plurality of cells;

a process of determining a symbol to be rearranged in each cell of the first to Nth scroll areas in a game;

a process of performing a first winning determination for determining a winning related to symbols when a predetermined number or more of the symbols of a same type consecutively appear from the first cell in the winning determination line;

a process of performing a second winning determination for determining a winning related to symbols when a predetermined number or more of the symbols of a same type consecutively appear from the Nth cell in the winning determination line; and a process of determining which one of the first winning determination and the second winning determination is to be employed depending on the type of the symbols.

According to the configuration mentioned above, the information processor runs a slot game, in which rearranging symbols in the first to the Nth scroll areas, performing the winning determination based on an arrangement pattern of the symbols on the winning determination line in the symbol display frame, and outputting a result. In the winning determination, the first winning determination and the second winning determination are adopted according to the type of symbols rearranged in the first to the Nth cells on the winning determination line. In the first winning determination, it is determined to win when a predetermined number or more of symbols of a same type consecutively appear from the first cell. In the second winning determination, it is determined to win when a predetermined number or more of symbols of a same type consecutively appear from the Nth cell. As a result, even in a case where the general scroll areas each sequentially performs a stop display at a time difference in the slot game, it is possible to present a possibility of winning based on the second winning determination to a player before all the scroll areas are stopped, no matter whether a desired type of symbols are not rearranged at a stage where only the first scroll area performs the stop display or a winning based on the first winning determination is denied at a stage where only the first scroll area and the second scroll area perform the stop display.

In addition, it is possible to respectively present the winning based on the first winning determination and the winning based on the second winning determination to the player in different patterns that are a pattern in which a predetermined number or more symbols of a same type are consecutively arranged from the first cell in the symbol display frame and a pattern in which a predetermined number or more symbols of a same type are consecutively arranged from the Nth cell in the symbol display frame. As a result, it is possible to provide an information processor capable of performing various presentations for the result display of the rearrangement of the symbols.

In the information processor of the present invention, the symbol belongs to one of the two groups as the type, the controller determines which one of the first winning determination and the second winning determination is to be employed depending on the group that the symbol belongs.

According to the configuration mentioned above, the symbols are divided into two groups, the winning related to the symbol of one group is consecutively displayed from the first scroll area, and the winning related to the symbol of the other group is consecutively displayed from the Nth scroll area. As a result, the winning related to the symbol of one group is displayed on the first scroll area side of the symbol display frame, and the winning related to the symbol of the other group is displayed on the Nth scroll area side of the symbol display frame. As a result, it is possible to display a result in a form like a battle between groups by dividing the symbols into two groups while being a game played by the player alone as the slot game, and the information processor can perform a various presentation.

In the information processor of the present invention, the number of the scroll areas is an even number, the controller increases the possibility of rearranging more symbols of the type of the group determined by the first winning determination at the first scroll area side which divides the first to the Nth scroll areas into two parts, compared to the Nth scroll area side, and increases the possibility of rearranging more symbols of the type of the group determined by the second winning determination at the Nth scroll area side which divides the first to the Nth scroll areas into two parts, compared to the first scroll area side.

According to the configuration mentioned above, the number of the scroll areas is an even number, and the possibility of rearranging symbols of the type of the group determined by the first winning determination at the first scroll area side increases, and the possibility of rearranging symbols of the type of the group determined by the second winning determination at the Nth scroll area side increases. Therefore, it is easy for the symbols to be rearranged to the first scroll area side and the Nth scroll area side of the symbol display frame depending on the two groups to which the symbols belong, and further, it is possible to clarify a form like a battle between groups, and the information processor can further perform a various presentation.

In the information processor of the present invention, the controller can select a group, such that a winning related to the type of symbols belonging to the selected group becomes advantageous.

According to the configuration mentioned above, a winning related to the type of symbols belonging to the selected group becomes advantageous. As a result, it is possible to make the result display in a form like a battle between groups more complicated, and it is possible for the information processor to perform a various presentation.

The present invention relates to a non-transitory computer-readable medium storing a game program which causes a computer comprising a display for displaying a screen to execute:

a process of setting a winning determination line composed of a first to a Nth cells each of which is one cell selected from each of a first to a Nth scroll areas provided in a symbol display frame which is displayed in the screen, and each scroll area is composed of a plurality of cells;

a process of determining a symbol to be rearranged in each cell of the first to Nth scroll areas in a game;

a process of performing a first winning determination for determining a winning related to symbols when a predetermined number or more of the symbols of a same type consecutively appear from the first cell in the winning determination line;

a process of performing a second winning determination for determining a winning related to symbols when a predetermined number or more of the symbols of a same type consecutively appear from the Nth cell in the winning determination line; and a process of determining which one of the first winning determination and the second winning determination is to be employed depending on the type of the symbols.

According to the configuration mentioned above, the game program runs a slot game, that is, rearranging the symbols in the first to the Nth scroll areas, performing the winning determination based on an arrangement pattern of the symbols on the winning determination line in the symbol display frame, and outputting a result. In the winning determination, the first winning determination and the second winning determination are adopted according to the type of symbols rearranged in the first to the Nth cells on the winning determination line. In the first winning determination, it is determined to win when a predetermined number or more of symbols of a same type consecutively appear from the first cell. In the second winning determination, it is determined to win when a predetermined number or more of symbols of a same type consecutively appear from the Nth cell. As a result, even in a case where the general scroll areas each sequentially performs a stop display at a time difference in the slot game, it is possible to present a possibility of winning based on the second winning determination to a player before all the scroll areas are stopped, no matter whether a desired type of symbols are not rearranged at a stage where only the first scroll area performs the stop display or a winning based on the first winning determination is denied at a stage where only the first scroll area and the second scroll area perform the stop display. In addition, it is possible to respectively present the winning based on the first winning determination and the winning based on the second winning determination to the player in different patterns that are a pattern in which a predetermined number or more symbols of a same type are consecutively arranged from the first cell in the symbol display frame and a pattern in which a predetermined number or more symbols of a same type are consecutively arranged from the Nth cell in the symbol display frame. As a result, it is possible to provide a game program capable of performing various presentations for the result display of the rearrangement of the symbols.

The present invention relates to a game control method executed by a computer which comprises a display for displaying a screen, the method comprising the steps of:

setting a winning determination line composed of a first to a Nth cells each of which is one cell selected from each of a first to a Nth scroll areas provided in a symbol display frame which is displayed in the screen, and each scroll area is composed of a plurality of cells;

a process of determining a symbol to be rearranged in each cell of the first to Nth scroll areas in a game;

performing a first winning determination for determining a winning related to symbols when a predetermined number or more of the symbols of a same type consecutively appear from the first cell in the winning determination line;

performing a second winning determination for determining a winning related to symbols when a predetermined number or more of the symbols of a same type consecutively appear from the Nth cell in the winning determination line; and determining which one of the first winning determination and the second winning determination is to be employed depending on the type of the symbols.

According to the configuration mentioned above, in the game control method, the computer runs a slot game, that is, rearranging the symbols in the first to the Nth scroll areas, performing the winning determination based on an arrangement pattern of the symbols on the winning determination line in the symbol display frame, and outputting a result. In the winning determination, the first winning determination and the second winning determination are adopted according to the type of symbols rearranged in the first to the Nth cells on the winning determination line. In the first winning determination, it is determined to win when a predetermined number or more of symbols of a same type consecutively appear from the first cell. In the second winning determination, it is determined to win when a predetermined number or more of symbols of a same type consecutively appear from the Nth cell. As a result, even in a case where the general scroll areas each sequentially performs a stop display at a time difference in the slot game, it is possible to present a possibility of winning based on the second winning determination to a player before all the scroll areas are stopped, no matter whether a desired type of symbols are not rearranged at a stage where only the first scroll area performs the stop display or a winning based on the first winning determination is denied at a stage where only the first scroll area and the second scroll area perform the stop display. In addition, it is possible to respectively present the winning based on the first winning determination and the winning based on the second winning determination to the player in different patterns that are a pattern in which a predetermined number or more symbols of a same type are consecutively arranged from the first cell in the symbol display frame and a pattern in which a predetermined number or more symbols of a same type are consecutively arranged from the Nth cell in the symbol display frame. As a result, it is possible to provide a game control method capable of performing various presentations for the result display of the rearrangement of the symbols.

The present invention is possible to perform various presentations for the result display of the rearrangement of the symbols.

BRIEF DESCRIPTION OF THE DRAWINGS

FIG. 8 is an illustrative view of a first symbol combination table of a slot machine.

FIG. 9 is an illustrative view of a second symbol combination table of the slot machine.

FIG. 10 is an illustrative view of a symbol array of a video reel of the slot game.

DETAILED DESCRIPTION OF THE PREFERRED EMBODIMENT

The information processor of the present invention will be described based on the drawings.

SUMMARY

Figure 1:
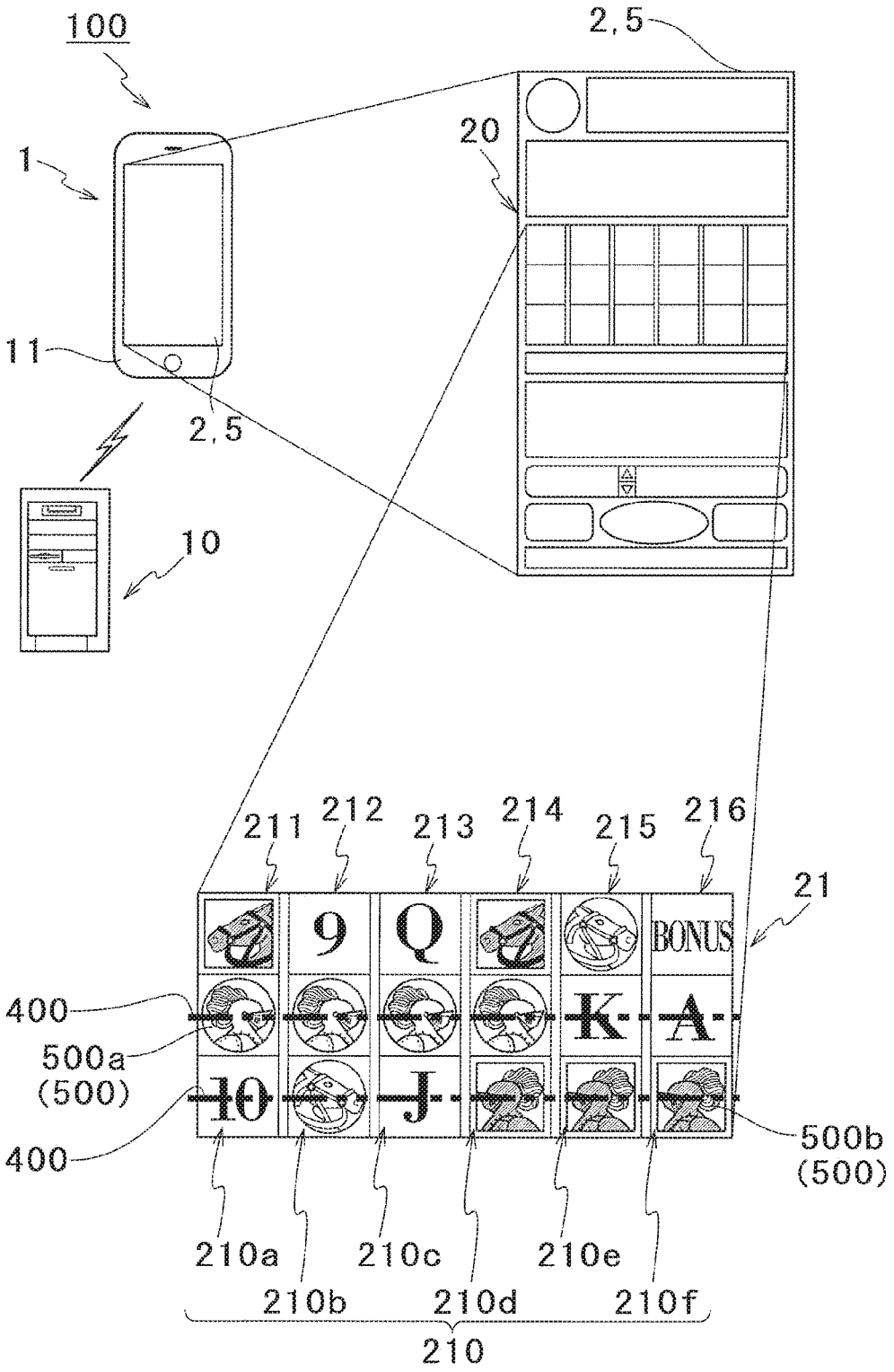
FIG. 1 is an illustrative view showing an operation state of the present invention.

As shown in FIG. 1, the information processor 1 is configured so that a winning determination method is selected according to a type of a symbol.

The information processor 1 is connected to the server 10 via a communication line so as to be capable of performing data communication and constitutes a game system 100 having the information processor 1 and the server 10. In addition, the game system 100 is not limited thereto, and it may be configured only by the information processor 1.

In the following description, it may be premised that the user logs in to the server 10 via the information processor 1. For example, the user logins through the authentication by the server 10 by inputting a user ID and a password in the information processor 1 via the communication line. In addition, the information processor 1 may also store the login information for the login authentication, and the user automatically logs in to the server 10 with the login information input by the user or stored when the user starts the game. In addition, the information processor 1 may also automatically log in to the server 10 with the stored login information by performing Biometrics authentication of the user when the user starts the game. As a biological information used in Biometrics authentication, known techniques such as a face, fingerprints, a retina, a iris, a vein pattern and voiceprint can be used. In this manner, the server 10 enables log in to the information processor 1 to run the game.

The game executed in the present embodiment can be executed as application software (program, game data) by being installed in a portable information processor such as a smart phone, a portable computer, a laptop computer, a notebook computer, a tablet type personal computer, a handheld type personal computer, and a PDA (Personal Data Assistant). The application software for executing this game is downloaded from a server (not shown) or the like by communication means and stored in a storage device in the information processor 1. Wherein, the communication means may be a bidirectional communication path such as the Internet or a cable television, or may be a broadcast that transmits information only in one direction.

In addition, the application software for executing the game may also be stored in a recording medium such as a floppy disk, a CD-ROM, a DVD-ROM, an MO (magneto-optical disk), a flash memory or the like, and read out from the recording medium as necessary and then installed in the storage device in the information processor 1.

In the game, a user can play a slot game. That is, the game has a slot game playable as a game element. In addition, the game may have plural kinds of slot games different in the effect pattern and the rule.

In the present embodiment, a smart phone will be described as an example of the information processor 1. The information processor 1 has a display 2 provided on the front surface of the casing 11 and a touch panel 5 provided on an entire surface of the display 2.

The display 2 is configured to be able to display images. The display method of the display 2 is, for example, liquid crystal, organic electroluminescence, CRT (Cathode Ray Tube), and plasma. The touch panel 5 is configured to be able to detect the coordinates of the site where the user's finger and the like touch. The touch panel 5 employs the known technique such as the electromagnetic induction method and the electrostatic capacitance method. The information processor 1 determines the object on the screen touched by the user and the touch state such as a swipe based on the coordinates detected by the touch panel 5, and performs a response corresponding to the determination result.

In addition, in the following description, when it is described that a certain object is selected by user, it means that the information processor 1 determines that a certain object is selected based on the operation of a user received by the touch panel 5.

In addition, in the present embodiment, the touch panel 5 functions as an input unit, receives a swipe input and a touch input, and the like, but it is not limited thereto. For example, as an input unit, it may be a microphone, a camera, or the like, which may receive the user's voice and gesture as an instruction to operate.

As shown in FIG. 1, a slot game screen 20 is displayed on the display 2. On the slot game screen 20, a symbol display area 21 as a symbol display frame is displayed in the center. In the symbol display area 21, a first scroll area 211, a second scroll area 212, a third scroll area 213, a fourth scroll area 214, a fifth scroll area 215, and a sixth scroll area 216 are provided. In each of the scroll areas 211 to 216, a total of three cells 210 are vertically arranged in the upper stage, the middle stage, and the lower stage. That is, a total of 18 cells 210 are arranged in the symbol display area 21 in a matrix of 6 columns and 3 rows. The cell 210 is a setting area that defines a symbol stop position, and may be displayed or not displayed. In one cell 210, one symbol 500 can be rearranged. That is, when the symbols 500 are rearranged, a total of 18 symbols 500 are arranged in a matrix of 6 columns and 3 rows. In addition, the number of the cells in the symbol display area 21 is not limited thereto.

In the symbol display area 21, one cell is selected from each of the scroll areas 211 to 216, and a winning determination line 400 constituted by these six cells 210 is set. That is, the winning determination line 400 includes any one of the first cells 210*a* of the first scroll area 211, any one of the second cells 210*b* of the second scroll area 212, any one of the third cells 210*c* of the third scroll area 213, any one of the fourth cells 210*d* of the fourth scroll area 214, any one of the fifth cells 210*e* of the fifth scroll area 215, and any one of the sixth cells 210*f* of the sixth scroll area 216 as a total of six cells 210. In the following description, the winning determination line may be referred to as a winning line or a payline. In addition, in the winning determination line 400, the arrangement order is determined in order of the first cell 210*a* to the sixth cell 210*f*. That is, in the winning determination line 400, the cell next to the first cell 210*a* is the second cell 210*b*, the cell next to the second cell 210*b* is the third cell 210*c*, the cell next to the third cell 210*c* is the fourth cell 210*d*, the cell next to the fourth cell 210*d* is the fifth cell 210*e*, and the cell next to the fifth cell 210*e* is the sixth cell 210*f*.

In such a winning determination line 400, two winning determinations, the first winning determination and the second winning determination, are respectively used according to the type of the symbol 500. Specifically, the symbol 500 has a first group symbol 500*a* in which a pattern is displayed in a round frame and a second group symbol 500*b* in which a pattern is displayed in a rectangular frame. In the first group symbol 500*a*, a winning is determined by the first winning determination. In the second group symbol 500*b*, a winning is determined by the second winning determination. The first group symbol 500*a* has a plurality of types of symbols 500, and the second group symbol 500*b* has a plurality of types of symbols 500 excluding the symbols 500 of the first group symbol 500*a*. In addition, there may be the symbols 500 belonging to both the first group symbol 500*a* and the second group symbol 500*b*, or there may be the symbols 500 not belonging to any of them. In addition, the symbols belonging to the group need only have a common display pattern, and the common display pattern may be different depending on the group, and it is not limited thereto.

The first winning determination is a winning determination method of determining a winning related to symbols 500 when a predetermined number or more of the symbols 500 of a same type consecutively appear from the first cell 210*a* in the winning determination line 400. In addition, the second winning determination is a winning determination method of determining a winning related to symbols 500 when a predetermined number or more of the symbols 500 of a same type consecutively appear from the sixth cell 210*f* in the winning determination line 400.

Specifically, the first winning determination is generally a winning determination method called "LEFT TO RIGHT". In the first winning determination, "consecutively" means that, in the winning determination line 400, there is no symbol 500 other than the type of symbol 500 related to the winning arranged in the cell 210 between the first cell 210*a* and the symbol 500 of the type related to the winning. For example, in a case where a winning is obtained by rearranging three of symbols 500 of a same type consecutively, the same type of symbols 500 need to be rearranged in the first cell 210*a*, the second cell 210*b*, and the third cell 210*c* on the winning determination line 40. For example, in a case where symbols 500 of a same type are rearranged in the second cell 210*b*, the third cell 210*c*, and the fourth cell 210*d* on the winning determination line 400, it is not a winning when a different type of symbol 500 is rearranged in the first cell 210*a*. Hereinafter, the first winning determination may be referred to as "LEFT TO RIGHT" in some cases.

For example, FIG. 1 shows the winning determination line 400 composed of a cell 210 at the middle stage of the first scroll area 211, a cell 210 at the middle stage of the second scroll area 212, a cell 210 at the middle stage of the third scroll area 213, a cell 210 at the middle stage of the fourth scroll area 214, a cell 210 at the middle stage of the fifth scroll area 215, and a cell 210 at the middle stage of the sixth scroll area 216. In the winning determination line 400, the first group symbol 500*a* is rearranged in the first cell 210*a* to the fourth cell 210*d*, and the winning related to the first group symbol 500*a* is determined by the first winning determination.

In addition, in the second winning determination, "consecutively" means that, in the winning determination line 400, there is no symbol 500 other than the type of symbol 500 related to the winning arranged in the cell 210 between the sixth cell 210*f* and the symbol 500 of the type related to the winning. For example, in a case where a winning is obtained by rearranging three of symbols 500 of a same type consecutively, the same type of symbols 500 need to be rearranged in the fourth cell 210*d*, the fifth cell 210*e*, and the sixth cell 210*f* on the winning determination line 40. For example, in a case where symbols 500 of a same type are rearranged in the third cell 210*c*, the fourth cell 210*d*, and the fifth cell 210*e* on the winning determination line 400, it is not a winning when a different type of symbol 500 is rearranged in the sixth cell 210*f*. Hereinafter, the second winning determination may be referred to as "RIGHT TO LEFT" in some cases.

For example, FIG. 1 shows the winning determination line 400 composed of a cell 210 at the lower stage of the first scroll area 211, a cell 210 at the lower stage of the second scroll area 212, a cell 210 at the lower stage of the third scroll area 213, a cell 210 at the lower stage of the fourth scroll area 214, a cell 210 at the lower stage of the fifth scroll area 215, and a cell 210 at the lower stage of the sixth scroll area 216. In the winning determination line 400, the second group symbol 500*b* is rearranged in the fourth cell 210*d* to the sixth cell 210*f*, and the winning related to the second group symbol 500*b* is determined by the second winning determination.

In this manner, the information processor 1 runs a slot game, in which rearranging the symbols 500 in the first scroll area 211 to the sixth scroll area 216, performing a winning determination based on the arrangement pattern of the symbols 500 on the winning determination line 400 in the symbol display area 21, and outputting a result. In the winning determination, the first winning determination and the second winning determination are adopted according to the type of symbols 500 rearranged in the first cell 210*a* to the sixth cell 210*f* on the winning determination line. In the first winning determination, it is determined to win when a predetermined number or more of symbols 500 of a same type consecutively appear from the first cell. In the second winning determination, it is determined to win when a predetermined number or more of symbols 500 of a same type consecutively appear from the sixth cell. As a result, even in a case where the general scroll areas 211 to 216 each sequentially performs a stop display at a time difference in the slot game, it is possible to present a possibility of winning based on the second winning determination to a player before all the scroll areas 211 to 216 are stopped, no matter whether a desired type of symbols 500 are not rearranged at a stage where only the first scroll area 211 performs the stop display or a winning based on the first winning determination is denied at a stage where only the first scroll area 211 and the second scroll area 212 perform the stop display. In addition, it is possible to respectively present the winning based on the first winning determination and the winning based on the second winning determination to the player in different patterns that are a pattern in which a predetermined number or more symbols 500 of a same type are consecutively arranged from the first cell 210*a* in the symbol display area 21 and a pattern in which a predetermined number or more symbols 500 of a same type are consecutively arranged from the sixth cell 210*f* in the symbol display area 21. As a result, it is possible to provide an information processor 1 capable of performing various presentations for the result display of the rearrangement of the symbols.

Figure 2:
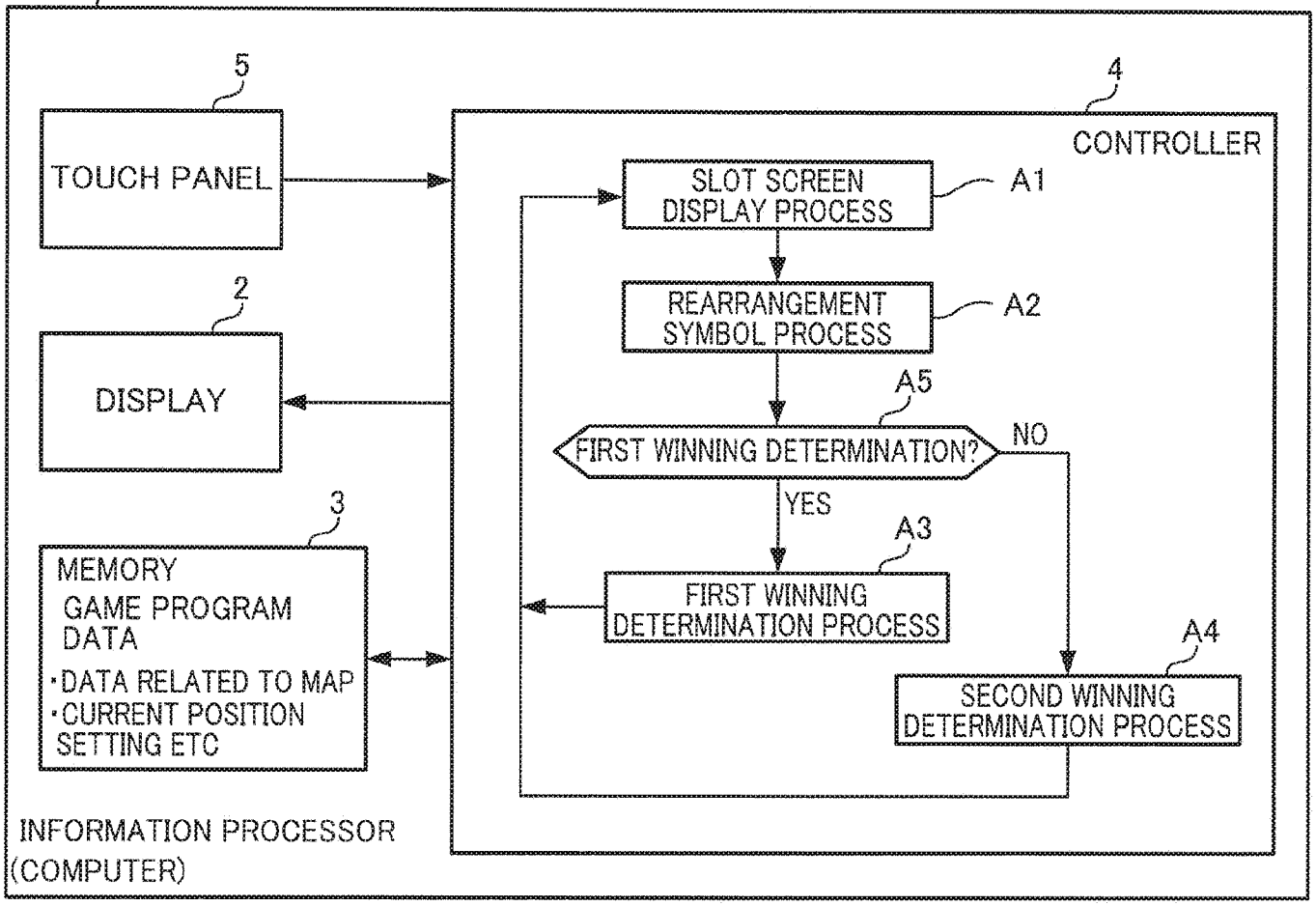
FIG. 2 is an illustrative view showing an schematic configuration of the present invention.

As shown in FIG. 2, a game system 100 has an information processor 1 and a server 10 as a computer, and has a display 2, a memory 3, a controller 4, and a touch panel 5.

The display 2 and the touch panel 5 are provided in the information processor 1, and function as an input unit and an output unit of the game system 100, respectively.

The memory 3 stores various programs including the game program to be executed by the controller 4 and various kinds of data for various programs. The memory 3 is a conceptual storage area of the game system 100, and it may be included by either the information processor 1 or the server 10. The function of the memory 3 may be distributed in the information processor 1 and the server 10, and alternatively, the function of the memory 3 may be provided to both of the information processor 1 and the server 10. That is, in the game program executed by the information processor 1, the information processor 1 requests the server 10 for data and the server 10 responds to the request for the data when it is required to be stored in the server 10.

The controller 4 executes various processes in accordance with the game program stored in the memory 3. The controller 4 is a conceptual execution unit of the game system 100, and it may be included by either the information processor 1 or the server 10. The function of the controller 4 may be distributed in the information processor 1 and the server 10, and alternatively, the function of the controller 4 may be provided to both of the information processor 1 and the server 10.

In this manner, the game system 100 functions as a computer having the information processor 1 as the input unit (the touch panel 5) and the output unit (the display 2) and the information processor 1 and/or the server 10 as the memory 3 and the controller 4.

The controller 4 is programmed to perform the following processes. In other words, a game program stored in the memory 3 executes the following processes in the game system 100 which is a computer. Specifically, the controller 4 executes a process (A1) of setting the winning determination line 400 composed of the first cell 210*a* to the sixth cell 210*f* each of which is one cell 210 selected from each of the first scroll area 211 to the sixth scroll area 216 provided in the symbol display area 21 which is displayed in the slot game screen 20, and each scroll area is composed of a plurality of cells 210; a process (A2) of determining the symbol 500 to be rearranged in each cell 210 of the first scroll area 211 to the sixth scroll area 216 in a game; a process (A3) of performing the first winning determination for determining the winning related to the first group symbol 500*a* when a predetermined number or more of the first group symbol 500*a* of a same type consecutively appears from the first cell 210*a* in the winning determination line 400; a process (A4) of performing the second winning determination for determining the winning related to the second group symbol 500*b* when a predetermined number or more of the second group symbol 500*b* of a same type consecutively appears from the sixth cell 210*f* in the winning determination line 400; and a process (A5) of determining which one of the first winning determination and the second winning determination is to be employed depending on the type of the symbol 500.

In this manner, the information processor 1 runs a slot game, in which rearranging the symbols 500 in the first scroll area 211 to the sixth scroll area 216, performing a winning determination based on the arrangement pattern of the symbols 500 on the winning determination line 400 in the symbol display area 21, and outputting a result. In the winning determination, the first winning determination and the second winning determination are adopted according to the type of symbols 500 rearranged in the first cell 210*a* to the sixth cell 210*f* on the winning determination line. In the first winning determination, it is determined to win when a predetermined number or more of symbols 500 of a same type consecutively appear from the first cell. In the second winning determination, it is determined to win when a predetermined number or more of symbols 500 of a same type consecutively appear from the sixth cell. As a result, even in a case where the general scroll areas 211 to 216 each sequentially performs a stop display at a time difference in the slot game, it is possible to present a possibility of winning based on the second winning determination to a player before all the scroll areas 211 to 216 are stopped, no matter whether a desired type of symbols 500 are not rearranged at a stage where only the first scroll area 211 performs the stop display or a winning based on the first winning determination is denied at a stage where only the first scroll area 211 and the second scroll area 212 perform the stop display. In addition, it is possible to respectively present the winning based on the first winning determination and the winning based on the second winning determination to the player in different patterns that are a pattern in which a predetermined number or more symbols 500 of a same type are consecutively arranged from the first cell 210*a* in the symbol display area 21 and a pattern in which a predetermined number or more symbols 500 of a same type are consecutively arranged from the sixth cell 210*f* in the symbol display area 21. As a result, it is possible to provide an information processor 1 capable of performing various presentations for the result display of the rearrangement of the symbols.

In addition, the game control method in which the processes of (A1) to (A5) are executed by the information processor 1 (computer) is realized by executing the processes of (A1) to (A5) by the information processor 1 having the above program. In other words, the information processor 1 has a plurality of processors that execute the processes of (A1) to (A5), respectively. In addition, in the following description, the information processor 1 will be described, but the processes and actions of the information processor 1 can be replaced with the invention of the program or the game control method. In addition, the process executed by the controller 4 may be executed only by the information processor 1, or the game system 100 having the server 10 may have a function. That is, the processes and the actions of the information processor 1 can be replaced with the invention of the game system 100.

In addition, the symbol 500 belongs to one of two groups (the first group symbol 500*a* and the second group symbol 500*b*) as the type, and the controller 4 may determine whether to employ the first winning determination or the second winning determination according to the group to which the symbol belongs.

According to the configuration mentioned above, the symbols are divided into two groups, the winning related to the symbol 500 of one group is consecutively displayed from the first scroll area 211, and the winning related to the symbol 500 of the other group is consecutively displayed from the sixth scroll area 216. As a result, the winning related to the first group symbol 500*a* of one group is displayed at the first scroll area 211 side of the symbol display area 21, and the winning related to the second group symbol 500*b* of the other group is displayed at the sixth scroll area 216 side of the symbol display area 21. As a result, it is possible to display a result in a form like a battle between groups by dividing the symbols 500 into two groups while being a game played by the player alone as the slot game, and the information processor can perform a various presentation.

In addition, the number of the scroll areas 211 to 216 may be an even number, and the controller 4 increases the possibility of rearranging more first group symbol 500*a* of the type of the group determined by the first winning determination at the first scroll area 211 side which divides the first scroll area 211 to the sixth scroll area 216 into two parts, compared to the sixth scroll area 216 side, and increases the possibility of rearranging more second group symbol 500*b* of the type of the group determined by the second winning determination at the sixth scroll area 216 side which divides the first scroll area 211 to the sixth scroll area 216 into two parts, compared to the first scroll area 211 side.

According to the configuration mentioned above, the number of the scroll areas 211 to 216 is an even number, and the possibility of rearranging the first group symbol 500*a* of the type of the group determined by the first winning determination at the first scroll area 211 side increases, and the possibility of rearranging the second group symbol 500*b* of the type of the group determined by the second winning determination at the sixth scroll area 216 side increases. Therefore, it is easy for the symbols to be rearranged to the first scroll area 211 side and the sixth scroll area 216 side of the symbol display area 21 depending on the two groups to which the symbols belong, and further, it is possible to clarify a form like a battle between groups, and the information processor 1 can further perform a various presentation.

In addition, the controller 4 may be able to select the group such that a winning related to the type of symbols 500 belonging to the selected group becomes advantageous.

According to the configuration mentioned above, a winning related to the type of symbols 500 belonging to the selected group becomes advantageous. As a result, it is possible to make the result display in a form like a battle between groups more complicated, and it is possible for the information processor 1 to perform a various presentation.

(Configuration of the Information Processor 1)

Figure 3:
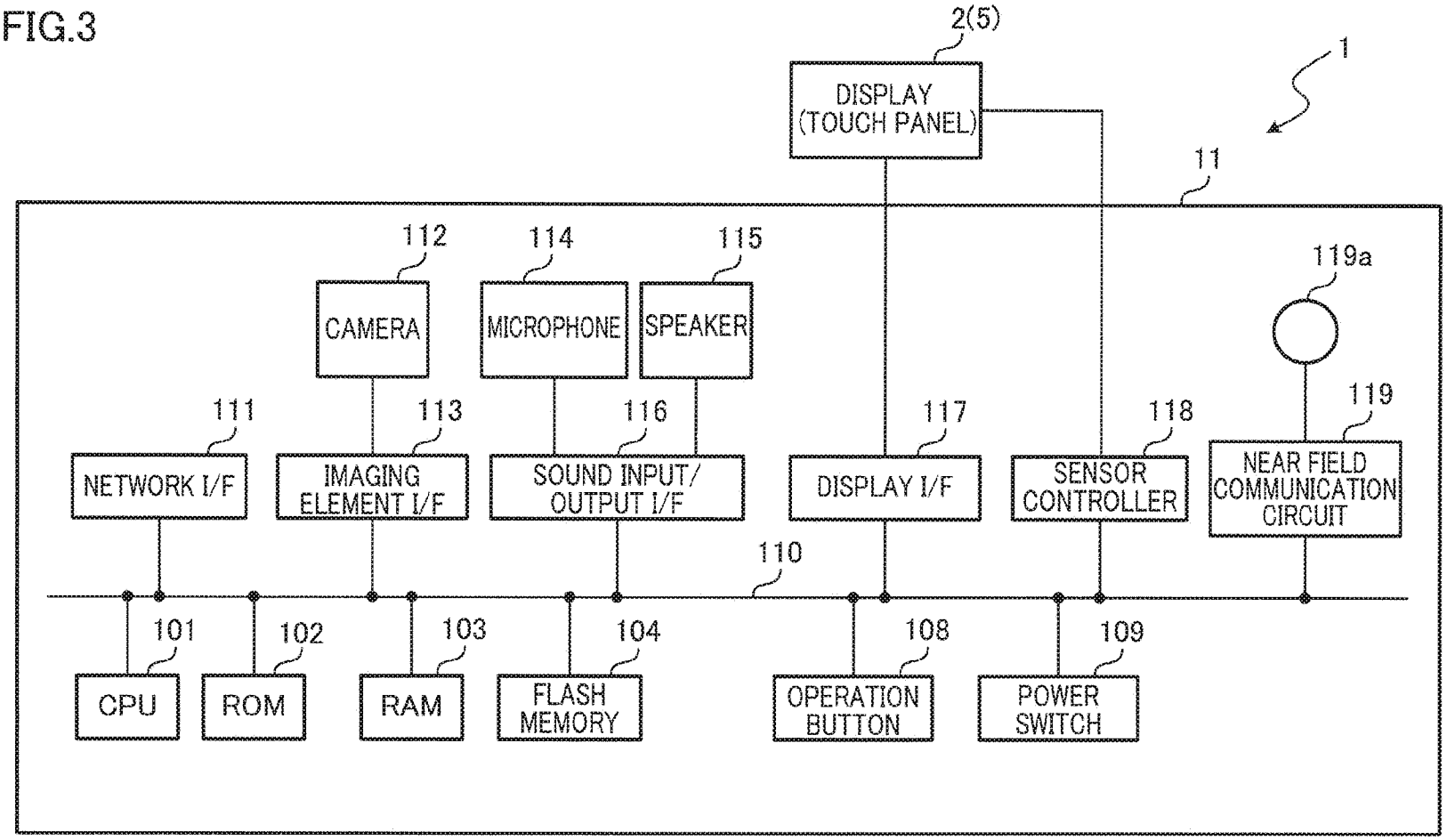
FIG. 3 is a block diagram showing an electric configuration of an information processor.

As shown in FIG. 3, the information processor 1 includes, in a casing 11, a CPU 101, a ROM 102, a RAM 103, a flash memory 104, an operation button 108, a power switch 109, a bus line 110, a network I/F 111, a camera 112, an imaging element I/F 113, a microphone 114, a speaker 115, a sound input/output I/F 116, a display I/F 117, a sensor controller 118, a near field communication circuit 119, and an antenna 119*a* of the near field communication circuit 119. In addition, on the front surface of the casing 11, the display 2 having a touch panel 5 (input unit) is installed.

The CPU (Central Processing Unit) 101 controls the overall actions of the information processor 1. The ROM (Read Only Memory) 102 stores programs for the driving of the CPU 101 such as an IPL (Initial Program Loader).

A RAM (Random Access Memory) 103 is used as a work area of the CPU 101. A flash memory 104 stores various kinds of data such as a application software (program), a communication program, an image data, and a sound data for executing the game according to this embodiment (game data necessary for a slot game such a symbol array, a symbol combination table of a video reel to be described later). The operation button 108 is a button that is operated when the information processor 1 is initially set. The power switch 109 is a switch for switching ON/OFF of the power of the information processor 1.

The network I/F (Interface) 111 is an interface for performing data communication by utilizing a communication network such as the Internet. The camera 112 is a built-in camera image capturing means which captures an image of an object to obtain image data under the control of the CPU 101. The imaging element I/F 113 is a circuit for controlling the camera 112. The microphone 114 is a built-in sound collection means to which sound is input. The sound input/output I/F 116 is a circuit for processing input and output of a sound signal between the microphone 114 and the speaker 115 under the control of the CPU 101. The display I/F 117 is a circuit for sending image data to the display 2 under the control of the CPU 101. The display 2 is provided on the front surface of the casing 11. The sensor controller 118 is a circuit for receiving an input from the touch panel 5 of the display 2. The near field communication circuit 119 is a communication circuit based on NFC (Near Field Communication) (Registered Trademark), Bluetooth (Registered Trademark), or the like. The bus line 110 is an address bus, a data bus, or the like for electrically connecting the components such as the CPU 101.

(Slot Game: Definitions)

The slot game is a game which is playable by the user as a game element in the game executed in the present embodiment, and a plurality of symbols are stop-displayed (rearranged) after variation in the symbol display area 21, and a benefit (a payout, item favorable/disadvantageous to users, and the like) is given by a combination of symbols displayed in the symbol display area 21 (see FIG. 1). In addition, a state in which a plurality of symbols are stop-displayed after variation in the symbol display area 21 is referred to as "rearrangement". In the slot game, a normal game may be performed, and when a predetermined condition is satisfied in the normal game, a bonus game which is more advantageous to the user than the normal game may be executed.

A "gaming value" may be given in the benefit given by the game result based on the combination of the symbols displayed in the symbol display area 21. The "gaming value" in this case is a coin, a bill or an electronic valuable information equivalent thereto. In addition, the "gaming value" is not particularly limited, and for example, when the slot game according to the present embodiment is executed by a gaming machine (slot machine) or the like installed in a hall or the like, it may be a medal, a token, an electronic money, a ticket, and the like. The ticket is not particularly limited, and may be, for example, a bar-coded ticket or the like. Further, the "gaming value" may also be a game point which does not have an valuable information.

In this embodiment, the coin is used as the gaming value. The coin is used as a pseudo substitute for credits in a game, and is used as a betting condition for execution of the slot game. That is, the user can bet a coin to play one slot game (unit game), and acquire a coin as a result of the slot game.

The "unit game" is a series of operations from the start of the receiving of a bet to a state in which an award can be established. To put it differently, the unit game includes a single bet time for receiving a bet, a single game time of rearranging stopped symbols, and a single payout time of a payout process of awarding a payout.

(Slot Game: function block)

Figure 4:
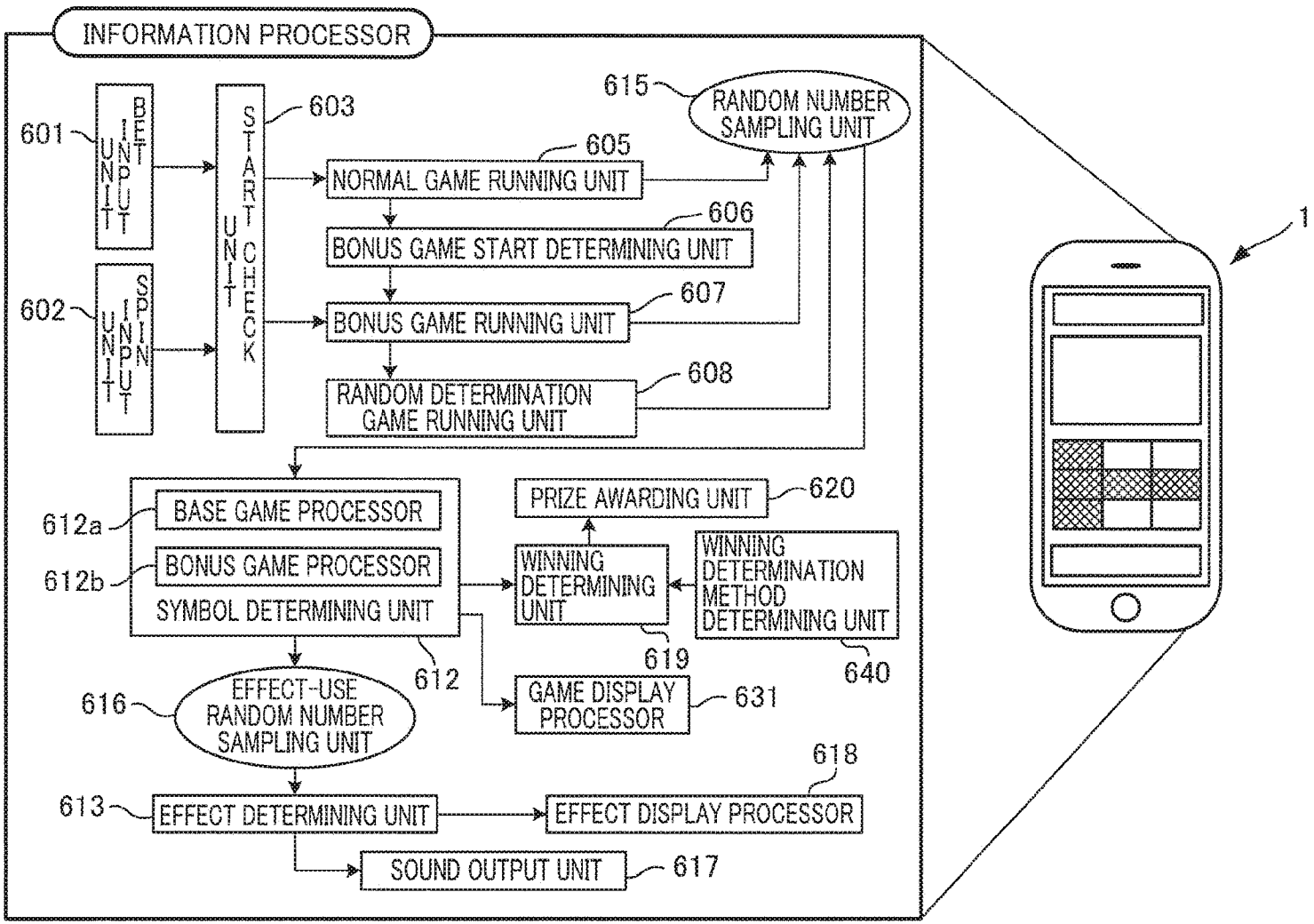
FIG. 4 is a functional block diagram of the information processor.

As shown in FIG. 4, the information processor 1 which is the gaming machine running the slot game has the following functions. To be more specific, the information processor 1 includes a BET input unit 601 and a spin input unit 602. The BET input unit 601 and the spin input unit 602 are input devices. The BET input unit 601 has a function of receiving a bet in response to a user's operation. The spin input unit 602 has a function of receiving a user's operation, i.e., an instruction to start a game.

In addition, the information processor 1 includes a start check unit 603, a normal game running unit 605, a bonus game start determining unit 606, a bonus game running unit 607, a random determination game running unit 608, a random number sampling unit 615, a symbol determining unit 612, an effect-use random number sampling unit 616, an effect determining unit 613, a sound output unit 617, an effect display processor 618, a winning determining unit 619, a prize awarding unit 620, a random determination game determination processor 630, a game display processor 631, and a winning determination method determining unit 640.

The normal game running unit 605 has a function of running a normal game which is a base game, on condition that the BET input unit 601 is operated. The bonus game start determining unit 606 determines whether to run a bonus game, based on a combination of the symbols rearranged in the normal game. In other words, the bonus game start determining unit 606 has functions of: determining that the player is entitled to a bonus game when a bonus symbol is rearranged; and activating the bonus game running unit 607 so as to run a bonus game from the subsequent unit game. The random determination game running unit 608 has a function of random determination including multiple bonuses of the bonus game, and the bonus game can be repeatedly executed by executing after the bonus game running unit 607.

The symbol determining unit 612 includes a base game processor 612*a* and a bonus game processor 612*b*. The symbol determining unit 612 including these processors 612*a* and 612*b* has functions of: determining symbols to be rearranged based on a random number given from the random number sampling unit 615; rearranging the determined symbols in the game area 291 of the display 2; outputting rearrangement information of the symbols to the winning determining unit 619; and outputting an effect instruction signal to the effect-use random number sampling unit 616, based on the combination of the rearranged symbols.

The effect-use random number sampling unit 616 has a function of sampling an effect random number when receiving an effect instruction signal from the symbol determining unit 612 and a function of outputting the effect random number to the effect determining unit 613. The effect determining unit 613 has functions of: determining an effect content by using the effect-use random number; outputting image information on the determined effect content to the effect display processor 618; and outputting audio and illumination information of the determined effect content to the sound output unit 617.

The winning determining unit 619 has functions of: determining whether a winning is achieved based on a combination of symbols when information rearrangement information of the symbols is given; calculating an amount of payout based on a winning combination formed when it is determined that a winning has been achieved; and outputting, to the prize awarding unit 620, a payout signal which is based on the payout amount. The prize awarding unit 620 has a function of payout out a gaming value to the user. The winning determination method determining unit 640 has a function of determining the winning determination method according to the type of the symbol. In addition, although not illustrated, the output contents of the processors described above are appropriately transmitted to the server 10 connected via the communication circuit.

(Slot Game: Game Contents)

The information processor 1 has three game modes as the slot game, namely the base game mode, the bonus game mode, and the random determination game mode. The information processor 1 shifts to the bonus game mode when the unit game is run in the base game mode and a bonus trigger condition is satisfied in the base game mode. The trigger of the bonus game is, for example, a condition in which three or more bonus symbols consecutively appear (are rearranged) from the first reel. The trigger of the bonus game may be another condition.

(Slot Game: Game Contents: base game mode)

The base game mode is specifically described. In the game area 291 displayed on the display 2 shown in FIG. 9, symbols for the slot game are rearrangeable on the video reels with three rows and six columns. In a betting process, a bet amount is selected by the user. The bet amount is, for example, selected from numbers such as 1, 2, 3, 5, and 10 by operating the bet button 244, and a desired number may be also input. The resource generated by accumulating parts of bet amounts is termed jackpot.

Next, in the game area 291, thereafter, as the symbols are rearranged by varying (scroll-moving) and stopping (scroll-stop) the video reels, winning determination is performed based on the state of the rearranged symbols (B3). For example, the bonus game trigger is established when the bonus symbols are consecutively rearranged from the first column area (first reel) to the six column area (sixth reel). The bonus game trigger is also established when the bonus symbols and a wild symbol which is able to substitute for the bonus symbol are consecutively rearranged.

(Slot Game: Game Contents: bonus game mode)

The base game mode shifts to the bonus game mode when the trigger condition of the bonus game is established, and a free game process is executed.

In the free game process, free game reel strips used in the free game are determined, and a predetermined number of times of execution of the free game is set. The reel strips for the free game and the number of times of execution of the free game may be randomly chosen from plural selected options such as reel strips.

As the free game is run, winning determination is executed. This winning determination may be identical with the winning determination in the base game. For example, when three or more bonus symbols consecutively appear from the first reel, the retrigger condition of the bonus game (free game) is established.

Then, it is determined whether a free game ends or not, and if the free game does not end, the free game continues, and the remaining free games are performed.

(Slot Game Screen)

Next, the slot game screen displayed on the display 2 will be described.

Figure 5:
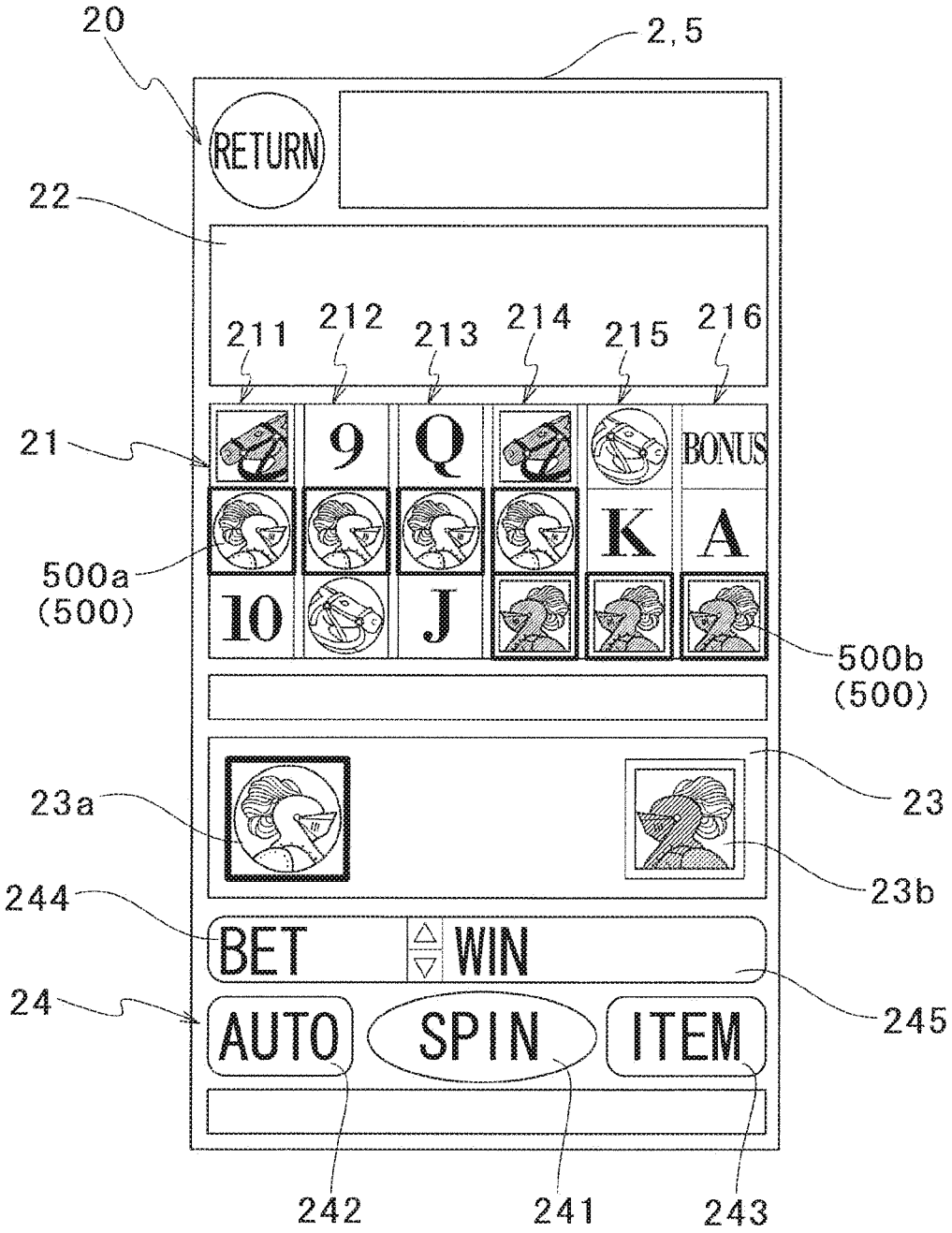
FIG. 5 is a diagram showing an example of a display screen of the information processor.

As shown in FIG. 5, when an operation for requesting a slot game screen from a predetermined screen (not shown) is performed in the game, the slot game screen 20 is displayed on the display 2. In the slot game screen, a symbol display area 21 composed of 18 areas in a matrix of 6 column×3 stages, a game information display area 22, an effect display area 23 for displaying a dynamic image, a still image, and a message such as a game character in accordance with the development of the slot game, and an operation display area 24 operated by the user for the progress of the slot game are displayed. In the operation display area 24, a spin button 241, an AUTO button 242, an ITEM button 243, a bet button 244, and a WIN display unit 245 are displayed.

Further, in the effect display area 23, a first group selection button 23*a* and a second group selection button 23*b* for selecting a group are displayed. Similarly to the first group symbol 500*a*, the first group selection button 23*a* has a form in which a pattern is displayed in a round frame. Similarly to the second group symbol 500*b*, the second group selection button 23*b* has a form in which a pattern is displayed in a rectangle frame. The button corresponding to the selected group is outlined and highlighted. The first group selection button 23*a* and the second group selection button 23*b* are selectable objects, and by selecting any one of them by the user, the group is set to the first group or the second group. It should be noted that the information processor 1 may perform a determination without the selection of the user. Also, the information processor 1 may perform a determination before it is selected by the user. Further, the information processor 1 may be determined to have fewer groups according to the selection status of a plurality of users.

The touch panel 5 that transmits the slot game screen is provided on the entire surface of the display 2. The touch panel 5 makes it possible to detect the coordinate of the site touched by the user's finger or the like. Thus, for example, by pressing the image of the spin button 241, one slot game (unit game) can be executed. In addition, by pressing the image of the AUTO button 242, the slot game can be continuously performed. In addition, when the image of the ITEM button 243 is pressed, it is possible to select/use an item possessed by the user (which gives an advantage or a disadvantage to the user in the slot game).

(Symbol Display Area 21)

As described above, in the symbol display area 21 of the slot game, six scroll areas (the first scroll area 211 to the sixth scroll area 216) are provided in which one column is divided into three areas of an upper stage, a middle stage, and a lower stage (three stages). Also, video reels (REEL 1, REEL 2, REEL 3, REEL 4, REEL 5, REEL 6) are displayed in the first scroll area 211 to the sixth scroll area 216, respectively. The video reels of the slot game of this embodiment express the actions of rotating and stopping the mechanical reel in which a plurality of symbols 500 are drawn on the peripheral surface thereof by a video, but it is not limited thereto. A symbol array composed of a plurality of symbols 500 is allocated to the video reels (REEL 1, REEL 2, REEL 3, REEL 4, REEL 5, REEL 6).

In the symbol display area 21, the symbol array allocated to the video reels (REEL 1, REEL 2, REEL 3, REEL 4, REEL 5, REEL 6) are respectively scrolled and stopped after a predetermined time. As a result, a part of each symbol array (three consecutive symbols in the slot game) is sequentially displayed in the symbol display area 21. In the first scroll area 211 to the sixth scroll area 216 of the symbol display area 21, three areas of the upper stage, the middle stage, and the lower stage respectively display one symbol correspondingly to the video reels (REEL 1, REEL 2, REEL 3, REEL 4, REEL 5, REEL 6). That is, in the symbol display area 21, 18 symbols of 6 columns×3 stages are displayed.

As described above, the slot game switches the first winning determination ("LEFT TO RIGHT" type) and the second winning determination ("RIGHT TO LEFT" type) according to the symbol 500 as the winning determination.

First, the "LEFT TO RIGHT" type as the first winning determination will be described more specifically. The "LEFT TO RIGHT" type first determines the area as the object of the winning determination from the 18 areas in 6 columns×3 stages of the symbol display area 21 by selecting six stages of the WAYS BET (WAYS BET 1, WAYS BET 2, WAYS BET 3, WAYS BET 4, WAYS BET 5, WAYS BET 6) (determination of an active area). Then, if symbols stopped in the area obtained as the object of the winning determination are consecutively connected in a predetermined number from the first scroll area 211 to the sixth scroll area 216, it is a winning. That is, the winning determination line 400 of all the patterns composed of the activated areas (cells 210) is provided in the symbol display area 21.

Figure 6:
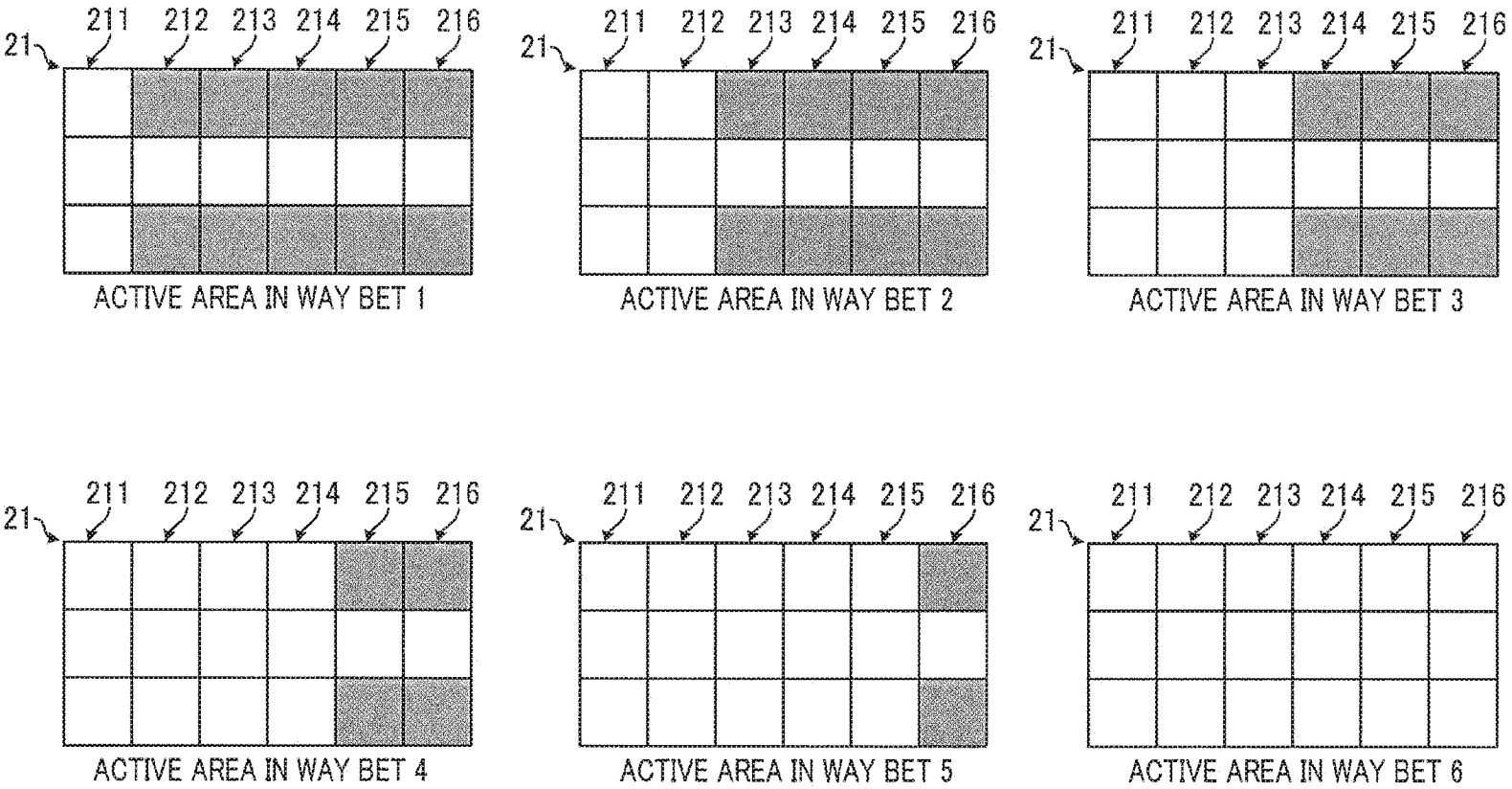
FIG. 6 is an illustrative view of an active area of a "WAYS BET" of a first winning determination.

Specifically, as shown in FIG. 6, when the "WAYS BET 1" is selected, the upper stage, the middle stage, and the lower stage of the first scroll area 211, the middle stage of the second scroll area 212, the middle stage of the third scroll area 213, the middle stage of the fourth scroll area 214, the middle stage of the fifth scroll area 215, and the middle stage of the sixth scroll area 216 of the symbol display area 21 become the objects of the winning determination (active). In addition, when the "WAYS BET 2" is selected, the upper stage, the middle stage, and the lower stage of the first scroll area 211, the upper stage, the middle stage, and the lower stage of the second scroll area 212, the middle stage of the third scroll area 213, the middle stage of the fourth scroll area 214, the middle stage of the fifth scroll area 215, and the middle stage of the sixth scroll area 216 of the symbol display area 21 become the objects of the winning determination (active). In addition, when the "WAYS BET 3" is selected, the upper stage, the middle stage, and the lower stage of the first scroll area 211, the upper stage, the middle stage, and the lower stage of the second scroll area 212, the upper stage, the middle stage, and the lower stage of the third scroll area 213, the middle stage of the fourth scroll area 214, the middle stage of the fifth scroll area 215, and the middle stage of the sixth scroll area 216 of the symbol display area 21 become the objects of the winning determination (active). In addition, when the "WAYS BET 4" is selected, the upper stage, the middle stage, and the lower stage of the first scroll area 211, the upper stage, the middle stage, and the lower stage of the second scroll area 212, the upper stage, the middle stage, and the lower stage of the third scroll area 213, the upper stage, the middle stage, and the lower stage of the fourth scroll area 214, the middle stage of the fifth scroll area 215, and the middle stage of the sixth scroll area 216 of the symbol display area 21 become the objects of the winning determination (active). In addition, when the "WAYS BET 5" is selected, the upper stage, the middle stage, and the lower stage of the first scroll area 211, the upper stage, the middle stage, and the lower stage of the second scroll area 212, the upper stage, the middle stage, and the lower stage of the third scroll area 213, the upper stage, the middle stage, and the lower stage of the fourth scroll area 214, the upper stage, the middle stage, and the lower stage of the fifth scroll area 215, and the middle stage of the sixth scroll area 216 of the symbol display area 21 become the objects of the winning determination (active). In addition, when the "WAYS BET 6" is selected, the upper stage, the middle stage, and the lower stage of the first scroll area 211, the upper stage, the middle stage, and the lower stage of the second scroll area 212, the upper stage, the middle stage, and the lower stage of the third scroll area 213, the upper stage, the middle stage, and the lower stage of the fourth scroll area 214, the upper stage, the middle stage, and the lower stage of the fifth scroll area 215, and the upper stage, the middle stage, and the lower stage of the sixth scroll area 216 of the symbol display area 21 become the objects of the winning determination (active). That is, when the "WAYS BET 6" is selected, all areas of the symbol display area 21 become the objects of the winning determination (activated).

Next, the "RIGHT TO LEFT" type as the second winning determination will be described in more detail. Similarly to the "LEFT TO RIGHT", the "RIGHT TO LEFT" type determines the area as the object of the winning determination from the 18 areas in 6 columns×3 stages of the symbol display area 21 by selecting six stages of the WAYS BET (determination of an active area). Then, if symbols stopped in the area obtained as the object of the winning determination are consecutively connected in a predetermined number from the sixth scroll area 216 to the first scroll area 211, it is a winning. That is, the winning determination line 400 of all the patterns composed of the activated areas (cells 210) is provided in the symbol display area 21.

Figure 7:
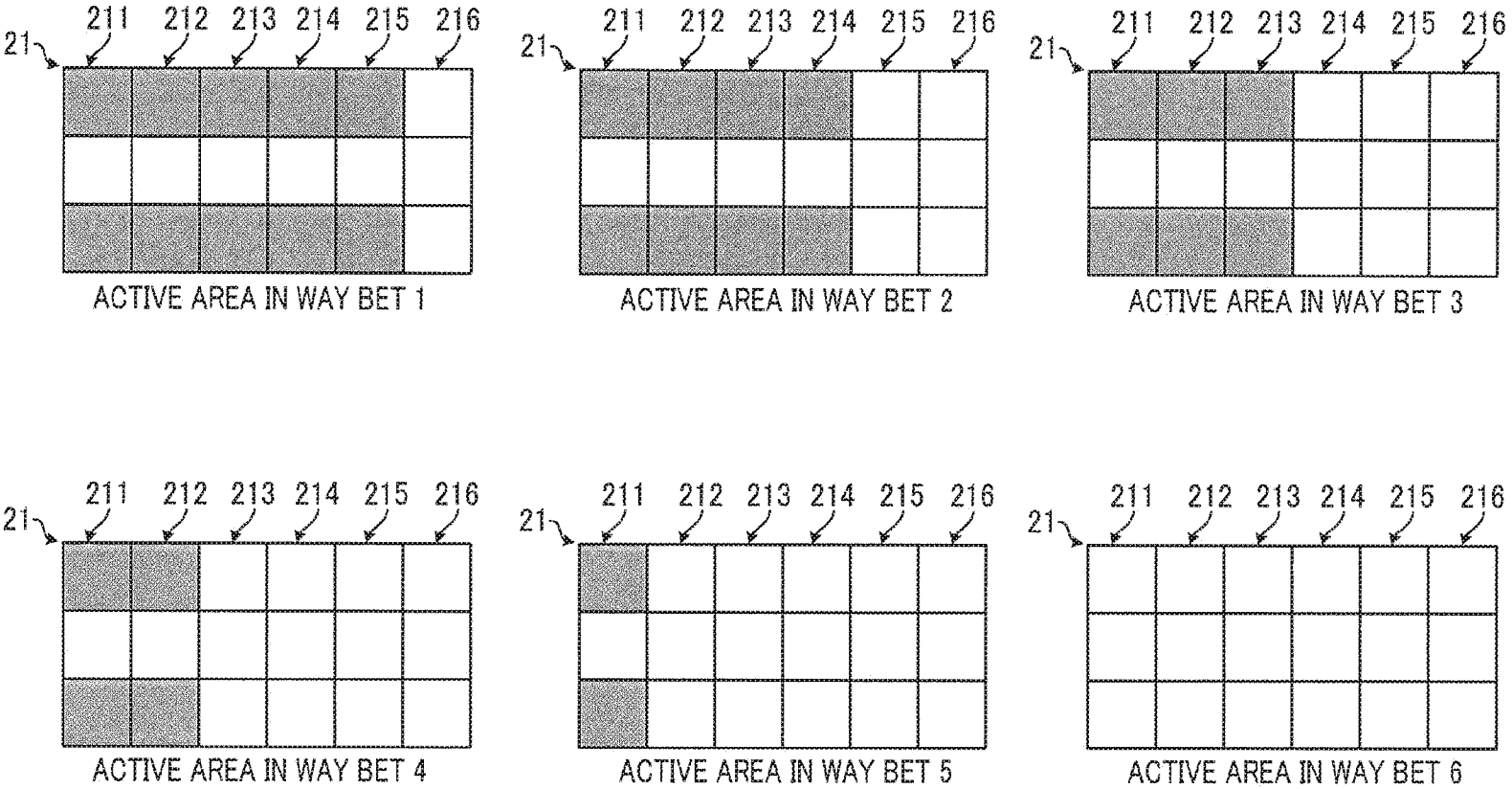
FIG. 7 is an illustrative view of an active area of a "WAYS BET" of a second winning determination.

Specifically, as shown in FIG. 7, when the "WAYS BET 1" is selected, the upper stage, the middle stage, and the lower stage of the sixth scroll area 216, the middle stage of the fifth scroll area 215, the middle stage of the fourth scroll area 214, the middle stage of the third scroll area 213, the middle stage of the second scroll area 212, and the middle stage of the first scroll area 211 of the symbol display area 21 become the objects of the winning determination (active). In addition, when the "WAYS BET 2" is selected, the upper stage, the middle stage, and the lower stage of the sixth scroll area 216, the upper stage, the middle stage, and the lower stage of the fifth scroll area 215, the middle stage of the fourth scroll area 214, the middle stage of the third scroll area 213, the middle stage of the second scroll area 212, and the middle stage of the first scroll area 211 of the symbol display area 21 become the objects of the winning determination (active). In addition, when the "WAYS BET 3" is selected, the upper stage, the middle stage, and the lower stage of the sixth scroll area 216, the upper stage, the middle stage, and the lower stage of the fifth scroll area 215, the upper stage, the middle stage, and the lower stage of the fourth scroll area 214, the middle stage of the fifth scroll area 213, the middle stage of the second scroll area 212, and the middle stage of the first scroll area 211 of the symbol display area 21 become the objects of the winning determination (active). In addition, when the "WAYS BET 4" is selected, the upper stage, the middle stage, and the lower stage of the sixth scroll area 216, the upper stage, the middle stage, and the lower stage of the fifth scroll area 215, the upper stage, the middle stage, and the lower stage of the fourth scroll area 214, the upper stage, the middle stage, and the lower stage of the third scroll area 213, the middle stage of the second scroll area 212, and the middle stage of the first scroll area 211 of the symbol display area 21 become the objects of the winning determination (active). In addition, when the "WAYS BET 5" is selected, the upper stage, the middle stage, and the lower stage of the sixth scroll area 216, the upper stage, the middle stage, and the lower stage of the fifth scroll area 215, the upper stage, the middle stage, and the lower stage of the fourth scroll area 214, the upper stage, the middle stage, and the lower stage of the third scroll area 213, the upper stage, the middle stage, and the lower stage of the second scroll area 212, and the middle stage of the first scroll area 211 of the symbol display area 21 become the objects of the winning determination (active). In addition, when the "WAYS BET 6" is selected, the upper stage, the middle stage, and the lower stage of the sixth scroll area 216, the upper stage, the middle stage, and the lower stage of the fifth scroll area 215, the upper stage, the middle stage, and the lower stage of the fourth scroll area 214, the upper stage, the middle stage, and the lower stage of the third scroll area 213, the upper stage, the middle stage, and the lower stage of the second scroll area 212, and the upper stage, the middle stage, and the lower stage of the first scroll area 211 of the symbol display area 21 become the objects of the winning determination (active). That is, when the "WAYS BET 6" is selected, all areas of the symbol display area 21 become the objects of the winning determination (activated).

Wherein, the selection of six stages of the WAYS BET (WAYS BET 1, WAYS BET 2, WAYS BET 3, WAYS BET 4, WAYS BET 5, WAYS BET 6) is performed by pressing the bet button 244 (see FIG. 5). It should be noted that the stage of the WAYS BET of six stages to be selected may be automatically determined depending on the number of coins inputted using the bet button 244, or in order to raise the stage of WAYS BET separately from the bet, additional coins may be required. In addition, in the present embodiment, the coins necessary for the WAYS BET at each stage are predetermined. Every time the stage of the WAYS BET increases, it is determined that necessary coins will increase. For example, to select WAYS BET 1, one coin is required. In addition, to select WAYS BET 2, three coins are required. In addition, to select WAYS BET 3, seven coins are required. In addition, to select WAYS BET 4, fifteen coins are required. In addition, to select WAYS BET 5, twenty-five coins are required. In addition, to select WAYS BET 6, thirty-five coins are required.

As described above, in the present embodiment, the winning determination line 400 is determined according to the WAYS BET, but it is not limited thereto. For example, a fixed regular winning determination line 400 may be predetermined in the symbol display area 21. In this case, all the winning determination lines 400 that can be configured in the symbol display area 21 may be set.

(Symbol Combination Table)

Next, the symbol combination table will be described with reference to FIGS. 8 and 9. FIGS. 8 and 9 are illustrative views of the first symbol combination table and the second symbol combination table used in the slot game according to the present embodiment. The symbol combination table of the slot game regulates the symbol combination (number of symbols) of symbols related to a winning (WIN), the payout amount (payout), and the winning determination method to be applied.

The types of the symbols 500 include a "BONUS", a "WHITE NIGHT", a "BLACK NIGHT", a "WHITE HORSE", a "BLACK HORSE", a "ACE", a "KING", a "QUEEN", a "JACK", a "TEN", a "NINE", a "WILD" which is a versatile symbol (a symbol of almighty) that replaces other symbols, and the like.

As shown in FIG. 8 and FIG. 9, the "WHITE NIGHT" and the "WHITE HORSE" belong to the first group symbol 500*a* to which the "LEFT TO RIGHT" is applied as the winning determination. In addition, the "BLACK NIGHT" and the "BLACK HORSE" belong to the second group symbol 500*b* to which the "RIGHT TO LEFT" is applied as the winning determination.

In addition, the "ACE", the "KING", the "QUEEN", the "JACK", the "TEN" and the "NINE" are normal symbols, and applicable to the "LEFT TO RIGHT" and the "RIGHT TO LEFT". In addition, the "WILD" symbol is applied as an alternative to the other symbols 500 in both "BLACK NIGHT" and "BLACK HORSE". In addition, the "BONUS" symbol is a symbol for which a winning is judged by a scatter type. That is, when a predetermined number (for example, three) or more are arranged in any of the symbol display areas 21, the winning related to the "BONUS" symbol is determined. When the winning related to the "BONUS" symbol is determined, a bonus game may be executed.

As described above, in the present embodiment, only a part of the symbols 500 belong to one of the two groups, but the present invention is not limited thereto. For example, all of the symbols 500 may belong to any one of the two groups except for the "WILD" and "BONUS" described above.

When the user touches the first group selection button 23*a* in the effect display area 23 of the slot game screen 20, the payout amount (payout) in the first symbol combination table is applied in subsequent unit game. In addition, when the user touches the second group selection button 23*b* in the effect display area 23 of the slot game screen 20, the payout amount (payout) in the second symbol combination table is applied in subsequent unit game.

As shown in FIG. 8, when the first group is selected by touching the first group selection button 23*a* in the effect display area 23 of the slot game screen 20, the winning related to the first group symbol 500*a* is set to be more advantageous than the winning related to the second group symbol 500*b*. To be more specific, in the first symbol combination table, the "WHITE NIGHT" symbol is set to a higher payout than the "BLACK NIGHT" symbol, and the "WHITE HORSE" symbol is set to a higher payout than the "BLACK HORSE" symbol.

In addition, as shown in FIG. 9, when the second group is selected by touching the second group selection button 23*b* in the effect display area 23 of the slot game screen 20, the winning related to the second group symbol 500*b* is set to be more advantageous than the winning related to the first group symbol 500*a*. To be more specific, in the second symbol combination table, the "BLACK NIGHT" symbol is set to a higher payout than the "WHITE NIGHT" symbol, and the "BLACK HORSE" symbol is set to a higher payout than the "WHITE HORSE" symbol.

(Symbol Array of the Video Reel)

Next, with reference to FIG. 10, the configuration of the symbol array included in the video reels of the slot game will be described.

As shown in FIG. 10, symbol arrays composed of the symbols corresponding to code numbers "0" to "33" are allocated to "Reel 1", "Reel 2", "Reel 3", "Reel 4", "Reel 5", and "Reel 6" of the video reels, respectively.

In addition, in the present embodiment, the probabilities of rearrangement of respective symbols in the symbol arrays are all set to be equal. That is, the probability of rearrangement increases as the number of symbols of a type in the symbol area increases.

As shown in FIG. 10, in the "Reel 1", the "Reel 2", and the "Reel 3", the number of the "WHITE NIGHT" is set to be larger than the number of the "BLACK NIGHT", and the number of the "BLACK HORSE" is set to be larger than the number of the "WHITE HORSE". That is, in the "Reel 1", the "Reel 2", and the "Reel 3", the probability that the first group symbol 500*a* is rearranged is higher than that of the second group symbol 500*b*.

Further, as shown in FIG. 10, in the "Reel 4", the "Reel 5", and the "Reel 6", the number of the "BLACK NIGHT" is set to be larger than the number of the "WHITE NIGHT", and the number of the "WHITE HORSE" is set to be larger than the number of the "BLACK HORSE". That is, in the "Reel 4", the "Reel 5", and the "Reel 6", the probability that the second group symbol 500*b* is rearranged is higher than that of the first group symbol 500*a*.

In this way, in the scroll areas 211 to 213 which are the left half areas of the scroll areas 211 to 216, the possibility that more symbols belonging to the first group symbol 500*a* to which the "LEFT TO RIGHT" is applied is rearranged is high. In addition, in the scroll areas 214 to 216 which are the right half areas of the scroll areas 211 to 216, the possibility that more symbols belonging to the second group symbol 500*b* to which the "RIGHT TO LEFT" is applied is rearranged is high.

In this way, it is easy for the symbols to be rearranged to the first scroll area 211 side and the sixth scroll area 216 side of the symbol display area 21 depending on the two groups to which the symbols belong, and further, it is possible to clarify a form like a battle between groups, and a presentation of various game results can be further performed.

The first group symbol 500*a* ("WHITE NIGHT", "WHITE HORSE"), which is more likely to be rearranged much on the left side, is drawn with a character pointing to the right. That is, it is rearranged in such a way as to go towards the second group symbol 500*b* to be rearranged much on the right side. In addition, likewise, the second group symbol 500*b* ("BLACK NIGHT", "BLACK HORSE"), which is more likely to be rearranged much on the right side, is drawn with a character pointing to the left. That is, it is rearranged in such a way as to go towards the second group symbol 500*b* to be rearranged much on the right side.

As described above, in the symbol display area 21, the left side area (the scroll areas 211 to 213) is displayed as if it is the position of the first group symbol 500*a*, and the right side area (the scroll areas 214 to 216) is displayed as if the it is the position of the second group symbol 500*b*. Then, when it is a winning of four or more consecutive first group symbol 500*a* by "LEFT TO RIHGT", the first group symbol 500*a* is rearranged in a pattern of entering the right side area displayed as the position of the second group symbol 500*b*. In addition, when it is a winning of four or more consecutive second group symbol 500*b* by "RIHGT TO LEFT", the second group symbol 500*a* is rearranged in a pattern of entering the left side area displayed as the position of the first group symbol 500*a*. In this way, it is possible to perform an effect with a pattern as a battle between groups only by rearranging the symbols 500 without performing a special effect by a video or the like.

[Contents of Program]

Next, a program of a slot game executed by the information processor 1 will be described with reference to FIG. 11 and FIG. 12.

(Slot Game Process)

Next, a game program of a slot game process executed by the CPU 101 of the information processor 1 will be described.

Figure 11:
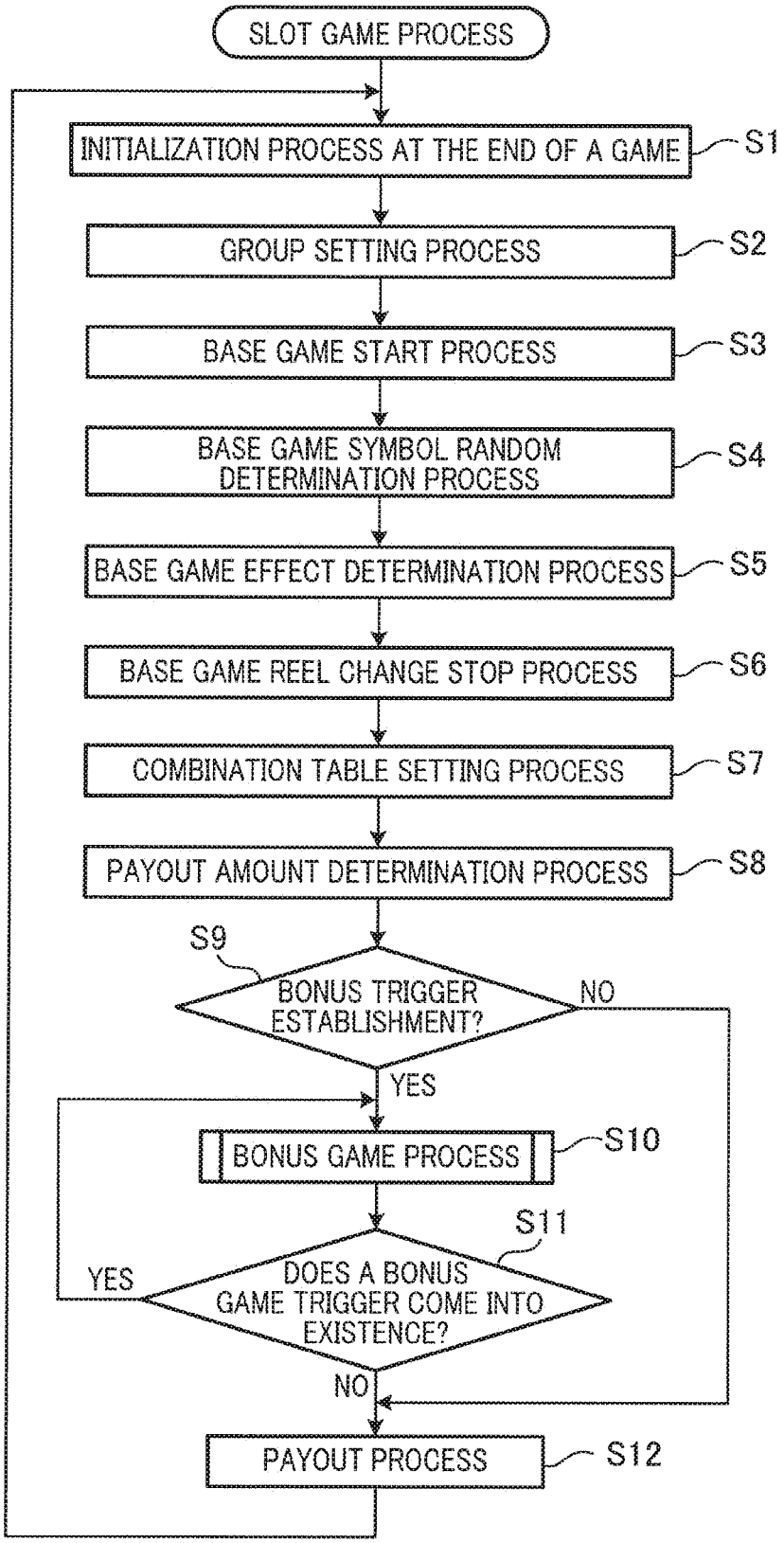
FIG. 11 is a flowchart of a slot game process.
Figure 12:
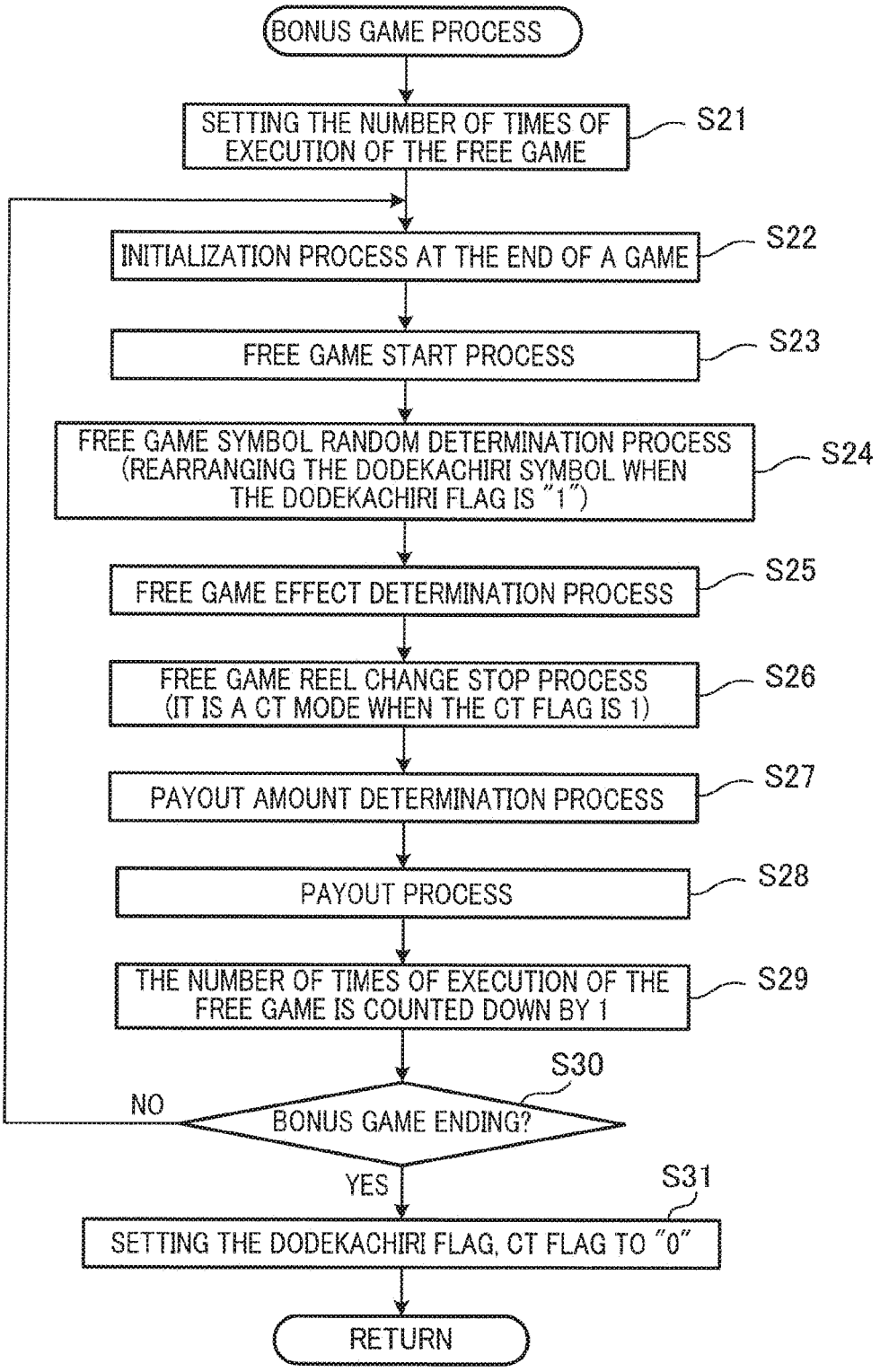
FIG. 12 is a flowchart of a bonus game process.

As shown in FIG. 11, an initializing process at the end of each play of the game is executed (S1). For example, this process clears data in a working area of the RAM 103, which becomes unnecessary at the end of each play of game, e.g., the bet amount and symbols selected by random determination. Then, a group setting process is executed (S2). In the group setting process, the CPU 101 determines whether or not the first group selection button 23*a* or the second group selection button 23*b* has been touched in the effect display area 23 of the slot game screen 20. When the group has been changed, the RAM 103 stores the group selected by the user after the change.

Then, a base game start process is executed (S3). In the base game start process, the CPU 101 performs an input check such as WAYS BET selected by the touch panel 5 or the like. Thereafter, a base game symbol random determination process is performed (S4). In this process, a to-be-stopped symbol based on the random number is selected and determined using the symbol random determination table.

Next, a base game effect determination process is performed (S5). The CPU 101 extracts an effect-use random number, determines one of a plurality of predetermined effect contents by random determination, and executes the effect content at the timing of the determined effect content. For example, the video for displaying the effect is displayed on the effect area of the display 2, and a control in which the sound is outputted by the speaker 115 or the like is performed.

Next, a base game reel variation stop process is performed (S6). In this process, scrolling of the symbol array in the symbol display area 21 is started, and the to-be-stopped symbol determined in the base game symbol random determination process is stopped at a predetermined position.

Next, a combination table setting process is performed (S7). That is, the first symbol combination table or the second symbol combination table is selected according to the group determined in step S2.

Next, a payout number determination process is performed (S8). To be more specific, based on the WAYS BET determined in step S3, the CPU 101 determines the winning determination line 400 for the first winning determination from the active area of the first winning determination (LEFT TO RIGHT) and determines the winning determination line 400 for the first winning determination from the active area of the second winning determination (RIGHT TO LEFT). Then, the CPU 101 determines whether or not the symbol 500 whose first winning determination is "TRUE" in the first symbol combination table is established in all the winning determination lines 400 of the first winning determination, and in the case of establishment, the number of consecutive arrangement is determined. Then, based on the first symbol combination table, the CPU 101 determines the payout amount for all the winnings related to the first winning determination.

Further, the CPU 101 determines whether or not the symbol 500 whose second winning determination is "TRUE" in the second symbol combination table is established in all the winning determination lines 400 of the second winning determination, and in the case of establishment, the number of consecutive arrangement is determined. Then, based on the second symbol combination table, the CPU 101 determines the payout amount for all the winnings related to the second winning determination. In addition, the CPU 101 determines whether or not a predetermined number or more of symbols with a scatter type are arranged in the symbol display area 21, and in the case where the symbols are arranged, the number of arrangement is determined, and the payout amount corresponding to the number of the arrangement is determined. Then, the CPU 101 stores all the determined payout amount in a payout amount storage area provided in the RAM 103.

Next, it is determined whether or not a bonus game trigger is established (S9). When it is determined that the bonus game trigger is established (S9: YES), a bonus game process is performed (S10). Thereafter, when the bonus game trigger is established (S10: YES), the bonus game process of S10 is executed again.

In the meanwhile, if the bonus game trigger has not been established in S9 or S11 (NO in S9 or S11), a payout process is executed (S11). The CPU 101 adds a value stored in the payout amount storage area to a value stored in a credit amount storage area (credit counter) provided in the RAM 103. Then the steps are executed again from S1.

(Bonus Game Process)

Next, with reference to FIG. 12, a subroutine, i.e. a game program of the bonus game process, of the slot game process executed by the CPU 101 of the information processor 1 will be described.

To begin with, the number of times of execution of the free game is set (S21). For example, the number of times of execution of the free game is set at 5. Then an initializing process at the end of each play of the game is executed (S22). For example, this process clears data in a working area of the RAM 103, which becomes unnecessary at the end of each play of game, e.g., the symbols selected by random determination. It is noted that the bet amount in the bonus game is identical with the bet amount in the base game immediately before the shift to the bonus game. That is, the WAYS BET of the stage in the base game that triggers the bonus game is used in the bonus game. That is, the winning determination lines 400 in both of the first winning determination and the second winning determination are the same as the winning determination line 400 in the base game that triggers the bonus game. In addition, for the group, the group selected in the base game that triggers the bonus game will be selected. Therefore, the payout amount of the symbol combination table applied in the base game that triggers the bonus game is also applicable in the bonus game.

Thereafter, in the same manner as in the base game, a free game start process (S23), a symbol random determination process (S24), and a free game effect determination process (S25) are executed. In the free game, a free game symbol random determination table different from the symbol random determination table in the base game is used. In the free game symbol random determination process, when a Huge Chili flag is set at 1, random determination is executed such that a Huge Chili symbol is to be rearranged.

Thereafter, a free game reel variation stop process (S26) is executed to vary and stop the reels. In this process, the free game is shifted to a CT mode when a CT flag is set at 1. In this mode, the user is allowed to forcibly stop the reels by an operation. Thereafter, a payout amount determination process (S27) and a payout process (S28) are serially executed, and then the number of times of execution of the free game is counted down by 1 (S29). Then whether the bonus game has ended is determined (S30). When the number of times of execution of the free game is not 0 (NO in S30), the steps are executed again from S22 as it is determined that the bonus game has not ended. In the meanwhile, when the number of times of execution of the free game is 0 (YES in S30), it is determined that the bonus game has ended. Then the Huge Chili flag and the CT flag are set at 0 (S31). As such, the flags are maintained at 0 in the bonus game after the base game, and the flags are changed from 1 to 0 in the bonus game after the random determination game. Then, the process is terminated, and returning to the routine of the slot game process.

Although not shown in the drawings, in the case of determining the payout amount in the slot game process and the bonus game process, the CPU 101 executes a process of transmitting the payout amount to the server 10 as the obtained number.

SUMMARY OF THE INVENTION

The information processor 1 comprises: a display 2 for displaying a screen; and a controller 4, the controller 4 executes: a process of setting the winning determination line 400 composed of the first cell 210*a* to the sixth cell 210*f* each of which is one cell 210 selected from each of the first scroll area 211 to the sixth scroll area 216 provided in the symbol display area 21 which is displayed in the screen, and each scroll area is composed of a plurality of cells 210; a process of determining the symbol 500 to be rearranged in each cell 210 of the first scroll area 211 to the sixth scroll area 216 in a game; a process of performing a determination based on "LEFT TO RIGHT" for determining a winning related to symbols 500 when a predetermined number or more of the symbols 500 of a same type consecutively appear from the first cell 210*a* in the winning determination line 400; a process of performing a determination based on "RIGHT TO LEFT" for determining a winning related to symbols 500 when a predetermined number or more of the symbols 500 of a same type consecutively appear from the sixth cell 210*f* in the winning determination line 400; and a process of determining whether to employ the "LEFT TO RIGHT" or the "RIGHT TO LEFT" according to the type of the symbol 500.

According to the configuration mentioned above, the information processor 1 runs a slot game, in which rearranging the symbols 500 in the first scroll area 211 to the sixth scroll area 216, performing a winning determination based on the arrangement pattern of the symbols 500 on the winning determination line 400 in the symbol display area 21, and outputting a result. In the winning determination, the determination based on the "LEFT TO RIGHT" and the determination based on the "RIGHT TO LEFT" are adopted according to the type of symbols 500 rearranged in the first cell 210*a* to the sixth cell 210*f* on the winning determination line 400. In the determination based on the "LEFT TO RIGHT", it is determined to win when a predetermined number or more of symbols 500 of a same type consecutively appear from the first cell 210*a*. In the determination based on the "RIGHT TO LEFT", it is determined to win when a predetermined number or more of symbols 500 of a same type consecutively appear from the sixth cell 210*f*. As a result, even in a case where the general scroll areas 211 to 216 each sequentially performs a stop display at a time difference in the slot game, it is possible to present a possibility of winning related to the determination based on the "RIGHT TO LEFT" to a player before all the scroll areas 211 to 216 are stopped, no matter whether a desired type of symbols 500 are not rearranged at a stage where only the first scroll area 211 performs the stop display or a winning related to the determination based on the "LEFT TO RIGHT" is denied at a stage where only the first scroll area 211 and the second scroll area 212 perform the stop display. In addition, it is possible to respectively present the winning related to the determination based on the "LEFT TO RIGHT" and the winning related to the determination based on the "RIGHT TO LEFT" to the player in different patterns that are a pattern in which a predetermined number or more symbols 500 of a same type are consecutively arranged from the first cell 210*a* in the symbol display area 21 and a pattern in which a predetermined number or more symbols 500 of a same type are consecutively arranged from the sixth cell 210*f* in the symbol display area 21. As a result, it is possible to provide an information processor 1 capable of performing various presentations for the result display of the rearrangement of the symbols 500.

In the information processor 1, the symbol 500 belongs to one of the two groups as the type, and the controller 4 determines whether to employ the determination based on the "LEFT TO RIGHT" or the determination based on the "RIGHT TO LEFT" according to the group to which the symbol 500 belongs.

According to the configuration mentioned above, the symbols 500 are divided into two groups, the winning related to the symbol 500 of one group is consecutively displayed from the first scroll area 211, and the winning related to the symbol 500 of the other group is consecutively displayed from the sixth scroll area 216. As a result, the winning related to the symbols 500 of one group are displayed at the first scroll area 211 side of the symbol display area 21, and the winning related to the symbols 500 of the other group are displayed at the sixth scroll area 216 side of the symbol display area 21. As a result, it is possible to display a result in a form like a battle between groups by dividing the symbols 500 into two groups while being a game played by the player alone as the slot game, and the information processor can perform a various presentation.

In the information processor 1, the number of scroll areas is an even number, and the controller 4 increases the possibility of rearranging more symbols 500 of the type of the group determined by the determination based on the "LEFT TO RIGHT" at the first scroll area 211 side which divides the first scroll area 211 to the sixth scroll area 216 into two parts, compared to the sixth scroll area 216 side, and increases the possibility of rearranging more symbols 500 of the type of the group determined by the determination based on the "RIGHT TO LEFT" at the sixth scroll area 216 side which divides the first scroll area 211 to the sixth scroll area 216 into two parts, compared to the first scroll area 211 side.

According to the configuration mentioned above, the number of the scroll areas is an even number, and the possibility of rearranging symbols 500 of the type of the group determined by the determination based on the "LEFT TO RIGHT" at the first scroll area 211 side increases, and the possibility of rearranging symbols 500 of the type of the group determined by the determination based on the "RIGHT TO LEFT" at the sixth scroll area 216 side increases. Therefore, it is easy for the symbols to be rearranged to the first scroll area 211 side and the sixth scroll area 216 side of the symbol display area 21 depending on the two groups to which the symbols 500 belong, and further, it is possible to clarify a form like a battle between groups, and the information processor 1 can further perform a various presentation.

In the information processor 1, the controller 4 is be able to select the group such that a winning related to the type of symbols 500 belonging to the selected group becomes advantageous.

According to the configuration mentioned above, a winning related to the type of symbols 500 belonging to the selected group becomes advantageous. As a result, it is possible to make the result display in a form like a battle between groups more complicated, and it is possible for the information processor 1 to perform a various presentation.

Embodiments of the present invention thus described above solely serve as specific examples of the present invention, and are not to limit the scope of the present invention. The specific structures and the like are suitably modifiable. Further, the effects described in the embodiments of the present invention described in the above embodiment are no more than examples of preferable effects brought about by the present invention, and the effects of the present invention are not limited to those described hereinabove.

In addition, in the above detailed description, for the sake of easier understanding of the present invention, a description has been given focusing on the characteristic part. The present invention is not limited to the embodiment described in the detailed description above, but may be applied to other embodiments, and the applicable range is various. In addition, terms and phraseology used in the present specification are used to clearly describe present invention and are not intended to limit the explanation of present invention. In addition, other configurations, systems, methods, and the like included in the concept of the present invention can be easily derived from the concept of the invention described in the present specification as long as it is a person skilled in the art. Therefore, the description of the claims must be regarded as including equivalent structures without departing from the range of the technical idea of the present invention. In addition, the abstract is intended to allow those skilled in the art, such as in the patent offices and general public offices, who know a little about the legal terms or the professional term and the like, to determine the technical content of the present application and the nature thereof rapidly though a simple search. Accordingly, the abstract is not intended to limit the scope of the invention as evaluated by the claims. In addition, in order to fully understand the purpose of the present invention and the specific effects of the present invention, it is desirable to make full reference and explanation of the already-disclosed document and the like.

The above detailed description includes a process performed by the computer. The above description and the present invention have been written for the purpose of enabling those skilled in the art to understand most effectively. In the present specification, each process used to derive a result should be understood as processes which are not self-contradictory. In addition, in each process, electric or electromagnetic signals are received, transmitted, recorded, or the like. In the processing of each process, such signal is expressed by bit, value, symbol, word, term, number, and the like, but it should be noted that it is used only for the convenience of illustration. In addition, in the processing of each process, there is a case which is described by a common expression with human actions, however, the processes described in this specification are executed in principle by various devices. In addition, the other structure required for performing each process can be clarified by the above description.

What is claimed is:

1. An information processor comprising:

a display for displaying a screen; and a controller, the controller being programmed to execute a game, including executing process of a process of causing to be displayed in the screen, as a first user interface, an operation button image and a process of determining whether the operation button image has been selected, with execution of the game beginning upon selection of the operation button image;

a process of causing a symbol display frame to be displayed in the screen, with the symbol display frame having N scroll areas that are each composed of a plurality of cells;

a process of setting a winning determination line composed of a first cell to an Nth cell, each of which first to Nth cells is one cell selected from each of the N scroll areas, the symbol display frame having a first-cell side and an Nth-cell side at an opposite side thereof;

a process of determining a symbol to be rearranged in each cell in the N scroll areas during execution of the game; and a process of determining whether an award is to be made and an amount thereof as a result of execution of the game, with the determination of whether an award is to be made and the amount thereof being based on a first winning evaluation and a second winning evaluation; wherein 1) the first winning evaluation is based on a predetermined number or more of symbols having a type that is the same consecutively appearing along the winning determination line from the first cell in the winning determination line toward the Nth cell in the winning determination line; and 2) wherein the second winning evaluation is based on a predetermined number or more of symbols having a type that is the same consecutively appearing along the winning determination line from the Nth cell in the winning determination line toward the first cell in the winning determination line;

wherein symbols belonging to a first group of symbols all appear with a first discernible direction in which they face and symbols belonging to a second group of symbols all appear with a second discernible direction in which they face that is opposite to the first discernible direction, with the first discernible direction being from the first-cell side of the display frame toward the Nth-cell side of the display frame and the second discernible direction being from the Nth-cell side of the display frame toward the first-cell side of the display frame, such that the symbols of the first group and the symbols of the second group appear in a confronting or opposing battle manner; and wherein the first winning evaluation is further based on a predetermined number or more of symbols belonging to the first group of symbols consecutively appearing along the winning determination line from the first cell in the winning determination line toward the Nth cell in the winning determination line; and 2) the second winning evaluation is further based on a predetermined number or more of symbols belonging to the second group of symbols consecutively appearing along the winning determination line from the Nth cell in the winning determination line toward the first cell in the winning determination line.

2. The information processor according to claim 1, wherein

N is an even number, the first through the (N/2)th scroll areas form a first scroll-area side of the symbol display frame and the (N/2+1)th through the Nth scroll areas form a second scroll-area side of the symbol display frame, more symbols belonging to the first group of symbols are likely to appear in the first scroll-area side of the display frame than in the second scroll-area side of the display frame, and more symbols belonging to the second group of symbols are likely to appear in the Nth scroll-area side of the display frame than in the first scroll-area side of the display frame.

3. The information processor according to claim 2, wherein the controller is further programmed to perform 1) a process of causing to be displayed in the screen, as a second user interface, a group-selection button image, and 2) a process of receiving a selection of a selected symbol group from among the first and second symbol groups, wherein an award based on symbols belonging to the selected symbol group is higher than an award based on symbols not belonging to the selected symbol group.

4. The information processor according to claim 1, wherein the controller is further programmed to perform 1) a process of causing to be displayed in the screen, as a second user interface, a group-selection button image, and 2) a process of receiving a selection of a selected symbol group from among the first and second symbol groups, wherein an award based on symbols belonging to the selected symbol group is higher than an award based on symbols not belonging to the selected symbol group.

5. A non-transitory computer-readable medium storing a game program causing a computer which comprises a display for displaying a screen to execute:

a process of causing to be displayed in the screen, as a first user interface, an operation button image and a process of determining whether the operation button image has been selected, with execution of the game beginning upon selection of the operation button image;

a process of causing a symbol display frame to be displayed in the screen, with the symbol display frame having N scroll areas that are each composed of a plurality of cells;

a process of setting a winning determination line composed of a first cell to an Nth cell, each of which first to Nth cells is one cell selected from each of the N scroll areas, the symbol display frame having a first-cell side and an Nth-cell side at an opposite side thereof;

a process of determining a symbol to be rearranged in each cell in the N scroll areas during execution of the game; and a process of determining whether an award is to be made and an amount thereof as a result of execution of the game, with the determination of whether an award is to be made and the amount thereof being based on a first winning evaluation and a second winning evaluation; wherein 1) the first winning evaluation is based on a predetermined number or more of symbols having a type that is the same consecutively appearing along the winning determination line from the first cell in the winning determination line toward the Nth cell in the winning determination line; and 2) wherein the second winning evaluation is based on a predetermined number or more of symbols having a type that is the same consecutively appearing along the winning determination line from the Nth cell in the winning determination line toward the first cell in the winning determination line;

wherein symbols belonging to a first group of symbols all appear with a first discernible direction in which they face and symbols belonging to a second group of symbols all appear with a second discernible direction in which they face that is opposite to the first discernible direction, with the first discernible direction being from the first-cell side of the display frame toward the Nth-cell side of the display frame and the second discernible direction being from the Nth-cell side of the display frame toward the first-cell side of the display frame, such that the symbols of the first group and the symbols of the second group appear in a confronting or opposing battle manner; and wherein the first winning evaluation is further based on a predetermined number or more of symbols belonging to the first group of symbols consecutively appearing along the winning determination line from the first cell in the winning determination line toward the Nth cell in the winning determination line; and 2) the second winning evaluation is further based on a predetermined number or more of symbols belonging to the second group of symbols consecutively appearing along the winning determination line from the Nth cell in the winning determination line toward the first cell in the winning determination line.

6. A game control method executed by a computer which comprises a display for displaying a screen, the method comprising the steps of:

causing to be displayed in the screen, as a first user interface, an operation button image and determining whether the operation button image has been selected, with execution of the game beginning upon selection of the operation button image;

causing a symbol display frame to be displayed in the screen, with the symbol display frame having N scroll areas that are each composed of a plurality of cells;

setting a winning determination line composed of a first cell to an Nth cell, each of which first to Nth cells is one cell selected from each of the N scroll areas, the symbol display frame having a first-cell side and an Nth-cell side at an opposite side thereof;

determining a symbol to be rearranged in each cell in the N scroll areas during execution of the game; and determining whether an award is to be made and an amount thereof as a result of execution of the game, with the determination of whether an award is to be made and the amount thereof being based on a first winning evaluation and a second winning evaluation; wherein 1) the first winning evaluation is based on a predetermined number or more of symbols having a type that is the same consecutively appearing along the winning determination line from the first cell in the winning determination line toward the Nth cell in the winning determination line; and 2) wherein the second winning evaluation is based on a predetermined number or more of symbols having a type that is the same consecutively appearing along the winning determination line from the Nth cell in the winning determination line toward the first cell in the winning determination line;

wherein symbols belonging to a first group of symbols all appear with a first discernible direction in which they face and symbols belonging to a second group of symbols all appear with a second discernible direction in which they face that is opposite to the first discernible direction, with the first discernible direction being from the first-cell side of the display frame toward the Nth-cell side of the display frame and the second discernible direction being from the Nth-cell side of the display frame toward the first-cell side of the display frame, such that the symbols of the first group and the symbols of the second group appear in a confronting or opposing battle manner; and wherein the first winning evaluation is further based on a predetermined number or more of symbols belonging to the first group of symbols consecutively appearing along the winning determination line from the first cell in the winning determination line toward the Nth cell in the winning determination line; and 2) the second winning evaluation is further based on a predetermined number or more of symbols belonging to the second group of symbols consecutively appearing along the winning determination line from the Nth cell in the winning determination line toward the first cell in the winning determination line.

* * * * *